United States Patent [19]

Horiguchi et al.

[11] 4,233,718

[45] Nov. 18, 1980

[54] METHOD FOR APPLYING A DESIRED SEALING PRESSURE BETWEEN REFRACTORY PLATES OF SLIDING NOZZLE

[75] Inventors: Hiroshi Horiguchi, Ohmiya; Terumoto Matsuo, Kitakyushu, both of Japan

[73] Assignees: Kurosaki Refractories Co. Ltd., Kitakyushu; Nippon Steel Corporation, Tokyo, both of Japan

[21] Appl. No.: 815,323

[22] Filed: Jul. 13, 1977

Related U.S. Application Data

[62] Division of Ser. No. 743,421, Nov. 19, 1976, Pat. No. 4,116,372.

[30] Foreign Application Priority Data

Nov. 26, 1975 [JP] Japan ..... 50-141791

[51] Int. Cl.[3] ..... B23P 15/00; B22D 41/08

[52] U.S. Cl. ..... 29/157 C; 29/252

[58] Field of Search ..... 29/157 C, 407, 252, 29/446; 222/600, 561, 504, 512

[56] References Cited

U.S. PATENT DOCUMENTS

| | | | |
|---|---|---|---|
| 3,480,186 | 11/1969 | Grosko | 251/175 |
| 3,706,244 | 12/1972 | Wilmeth | 29/407 |
| 3,760,993 | 9/1973 | Meier | 222/561 |
| 3,764,042 | 10/1973 | Shapland et al. | 222/600 |
| 3,786,969 | 1/1974 | Kelly | 222/537 |
| 3,841,539 | 10/1974 | Shapland, Jr. et al. | 222/600 |
| 3,856,189 | 12/1974 | Meier | 222/561 |
| 3,882,920 | 5/1975 | Barnes et al. | 29/252 |
| 3,912,134 | 10/1975 | Poran | 222/512 |
| 3,921,866 | 11/1975 | Palazzo | 222/512 |
| 3,937,372 | 2/1976 | Bode, Jr. | 222/561 |
| 4,063,668 | 12/1977 | Shapland et al. | 222/600 |

*Primary Examiner*—Daniel C. Crane
*Attorney, Agent, or Firm*—Jordan and Hamburg

[57] ABSTRACT

A method and apparatus for applying a sealing pressure to the stationary and sliding refractory plates of a sliding nozzle regulating the flow of molten metal from a vessel containing such molten metal. The method includes the steps of positioning the sliding nozzle across the discharge opening of the vessel, applying the desired sealing pressure to the refractory plates mounted between upper and lower metal frames, and then connecting the upper and lower metal frames to secure the refractory plates therebetween and maintain the sealing pressure.

4 Claims, 51 Drawing Figures

FIG. 28-a
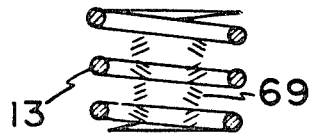
FIG. 28-b
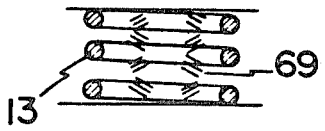
FIG. 29
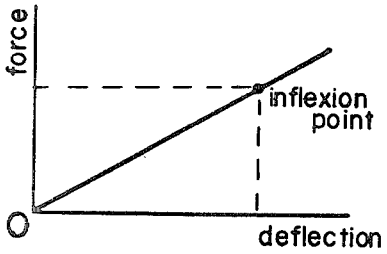
FIG. 30
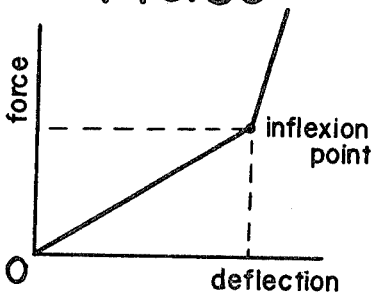
FIG. 31
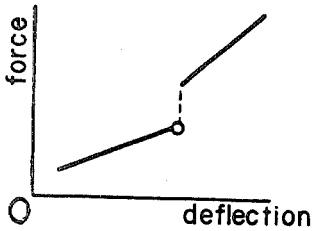
FIG. 32
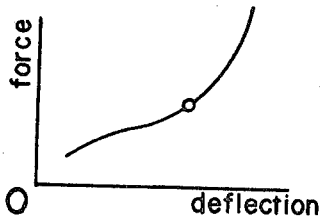

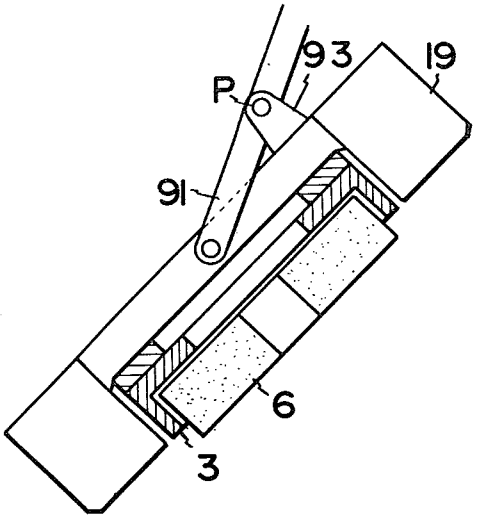
FIG.45-B
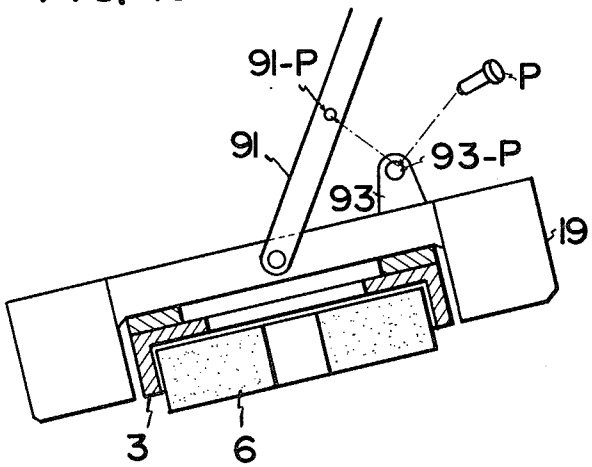
FIG. 45-A

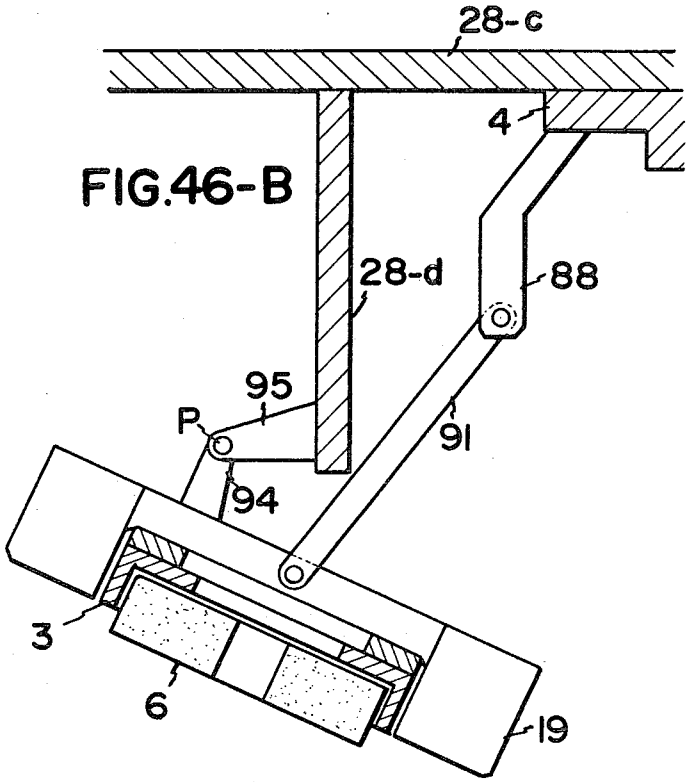
FIG.46-B
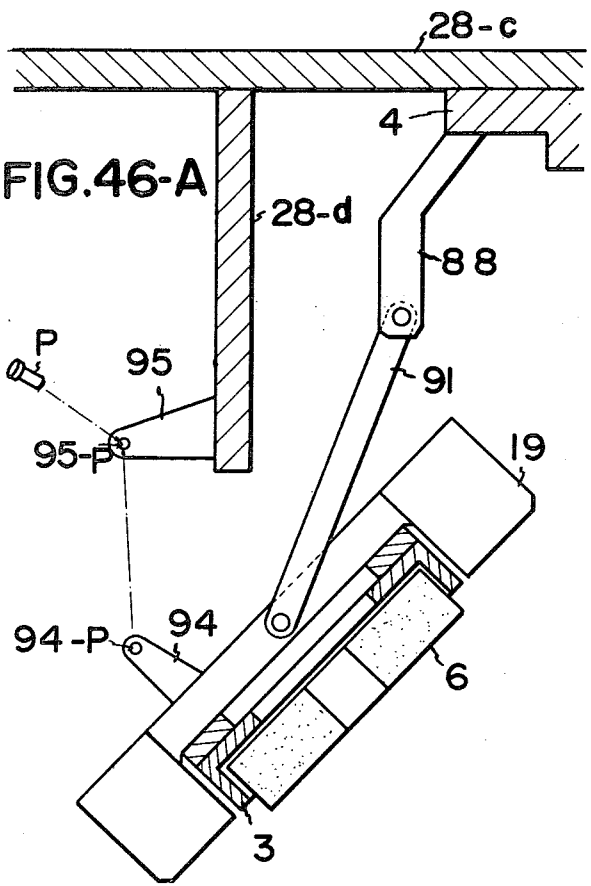
FIG.46-A

METHOD FOR APPLYING A DESIRED SEALING PRESSURE BETWEEN REFRACTORY PLATES OF SLIDING NOZZLE

This is a division of application Ser. No. 743,421, filed Nov. 19, 1976, now U.S. Pat. No. 4,116,372, issued Sept. 26, 1978.

BACKGROUND OF THE INVENTION

This invention relates to a method and apparatus for regulating the sealing pressure between refractory plates of a sliding nozzle which controls the flow of molten metal from the pour opening of a molten metal vessel such as a ladle, a turndish or a converter furnace.

The conventional methods for achieving the above purpose have been described in publications such as U.S. Pat. No. 311,902, Japanese Pat. SHO 39-2215, Japanese Pat. SHO 45-20587, and Japanese laid-open application 48-6982 and so on.

However, the above methods share the same defects in mounting the refractory plates.

Namely, for the purpose of obtaining completely tight sealing between the plates, the sliding surface of the sliding refractory plate and the corresponding surface of the stationary refractory plate must be polished to a flatness or surface finish of less than 0.05 mm.

Another important condition for facilitating the complete sealing of the refractory plates besides the flatness or surface finish of the plates is the sealing pressure, namely the pressure which obtains at the interface of the plates.

The following are conventional methods for applying the above sealing pressure:

(1) fastening the upper and lower metal frames by nut and bolt means, (2) fastening the upper and lower metal frames by a combination of springs and nut and bolt means, (3) fastening the upper and lower metal frames by toggle mechanisms.

In the first and second methods, the nuts and bolts are fastened by a torque wrench, however, the sealing pressure which is substantially a very important factor in achieving complete sealing, can not be determined accurately due to the friction or wear on the threads of the nuts and the bolts.

In the third method, the toggle mechanism cannot constantly maintain the desired sealing pressure between the refractory plates when the thickness of such refractory plates varies due to wear or due to variations in size which occur during the production thereof.

Furthermore, the above method requires heavy manual labor in a high temperature atmosphere.

It is an object of the present invention to provide a method which resolves the aforementioned disadvantages and wherein complete and stable sealing can be obtained between the refractory plates without necessitating any manual labor.

It is another object of the present invention to provide a method for applying a desired sealing pressure between the refractory plates of a sliding nozzle which is characterized in that a lower metal frame which encases the sliding refractory plate is urgingly pressed toward a fixed metal frame which encases the stationary refractory plate by a desired press means which can be replaceably mounted relative to the sliding nozzle so that the desired sealing pressure can be obtained between the refractory plates without necessitating manual labor.

It is still another object of the present invention to provide a sliding nozzle device which includes a mechanism for replaceably mounting the press means and another mechanism for maintaining the sealing pressure between the refractory plates once the desired sealing pressure has been obtained by the press means.

It is a further object of the present invention to provide a sliding nozzle device for achieving the objectives of the above method wherein the device is characterized by improvements formed on each substantial part or constituting element of the device such as the refractory plate, the sliding mechanism or the spring means.

It is still a further object of the present invention to provide a method for applying a desired sealing pressure between the refractory plates of a sliding nozzle wherein the press means which urges the lower metal frame toward the upper metal frame is provided with a hydraulic pressure gauge so that the desired and accurate sealing pressure can be constantly maintained between the refractory plates.

The above and further objects of the invention will more fully appear from the following detailed description of the invention when the same is read in connection with the accompanying drawings.

It is to be expressly understood, however, that the drawings are for purpose of illustration only and are not intended as a definition of the limits of the invention.

BRIEF DESCRIPTION OF THE DRAWINGS

FIG. 28(*a*) and FIG. 28(*b*) are schematic views showing the spring means of this invention in free and compressed positions respectively.

FIG. 29 through FIG. 32 are schematic diagrams showing each relationship between the deflection and the spring force of various spring means.

FIG. 43 through FIG. 48 are transverse cross sectional views of various sliding nozzles of this invention in which a pivotable closure metal frame can be utilized to apply a sealing pressure between the refractory plates.

DETAILED DESCRIPTION OF THE INVENTION

Figure 1:
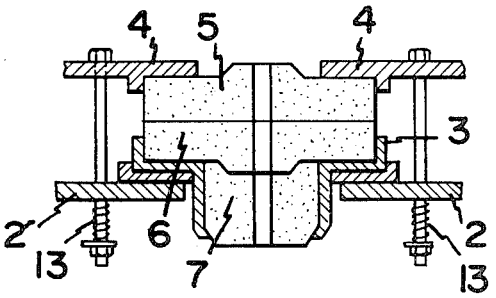
FIG.1 PRIOR ART
FIG. 1 is a transverse cross sectional view of a conventional sliding nozzle.

The basic or principle concept of the present invention is disclosed in the following description of the apparatus in which the method of this invention is embodied.

A stationary metal frame 4 is fixedly secured to the outer surface of the bottom of a ladle vessel 28 in the location where a pour opening for molten metal is provided. Depending arms 8 which have openings 9 at their distal ends have their proximal ends secured to metal frame 4. A stationary refractory plate 5 rests within a recess formed in the metal frame 4. A spring holding plate 25 is disposed in spaced relation below fixed metal frame 4 and is supported by a press means 12.

Arms 11 extend upwardly from the surface of spring holding plate 25, and have openings 10 at their distal ends are mounted such that the distal ends face those of arms 8.

Above the spring holding plate 25 there is positioned a lower metal frame 1 which accommodates a sliding refractory plate 6, a pouring nozzle 7 and a sliding metal frame 3. The upper surface of the surface of sliding refractory plate 6 is in contact with the lower surface of stationary refractory plate 5. Springs 13 are provided between lower metal frame 1 and the spring holding plate 25.

After completing the above assembly, press means 12 is actuated such that openings 10 of arms 11 are brought into alignment with openings 9 of depending arms 8. Retaining shafts (retaining means) 14 are then inserted through aligned openings 9 and 10 whereby arms 8 and 11 are connected.

In the sliding nozzle constructed or assembled in this manner an interface sealing pressure between stationary plate 5 and sliding plate 6 is determined by two factors wherein one is the distance between fixed metal frame 4 and spring holding plate 25 and the other is the compression strength of springs 13.

Accordingly, by employing springs 13 whose spring constant is already known, the position or location of openings 9,10 of arms 11 and 8 can be predetermined. The thus prepared sliding nozzle device is assembled to completion by the press means 12 in a way described heretofore so that the development of the desired sealing pressure between the refractory plates 5 and 6 is achieved.

As press means 12, a screw means, a hydraulic or pneumatic cylinder, a lifter, a link mechanism or a lever mechanism may be employed.

Figure 2:
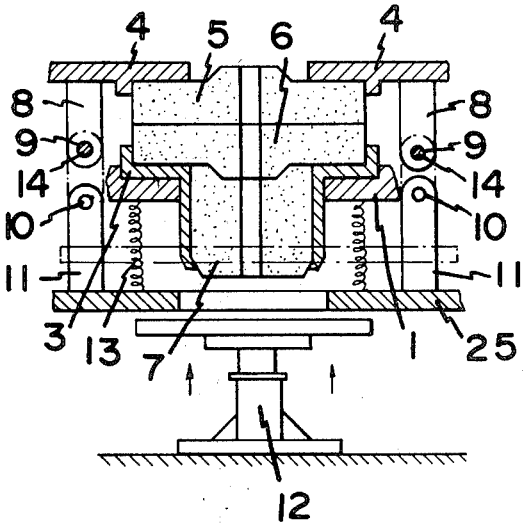
FIG. 2 is a transverse cross sectional view of a sliding nozzle of this invention which is being used for describing the basic concept of the invention.
Figure 3:
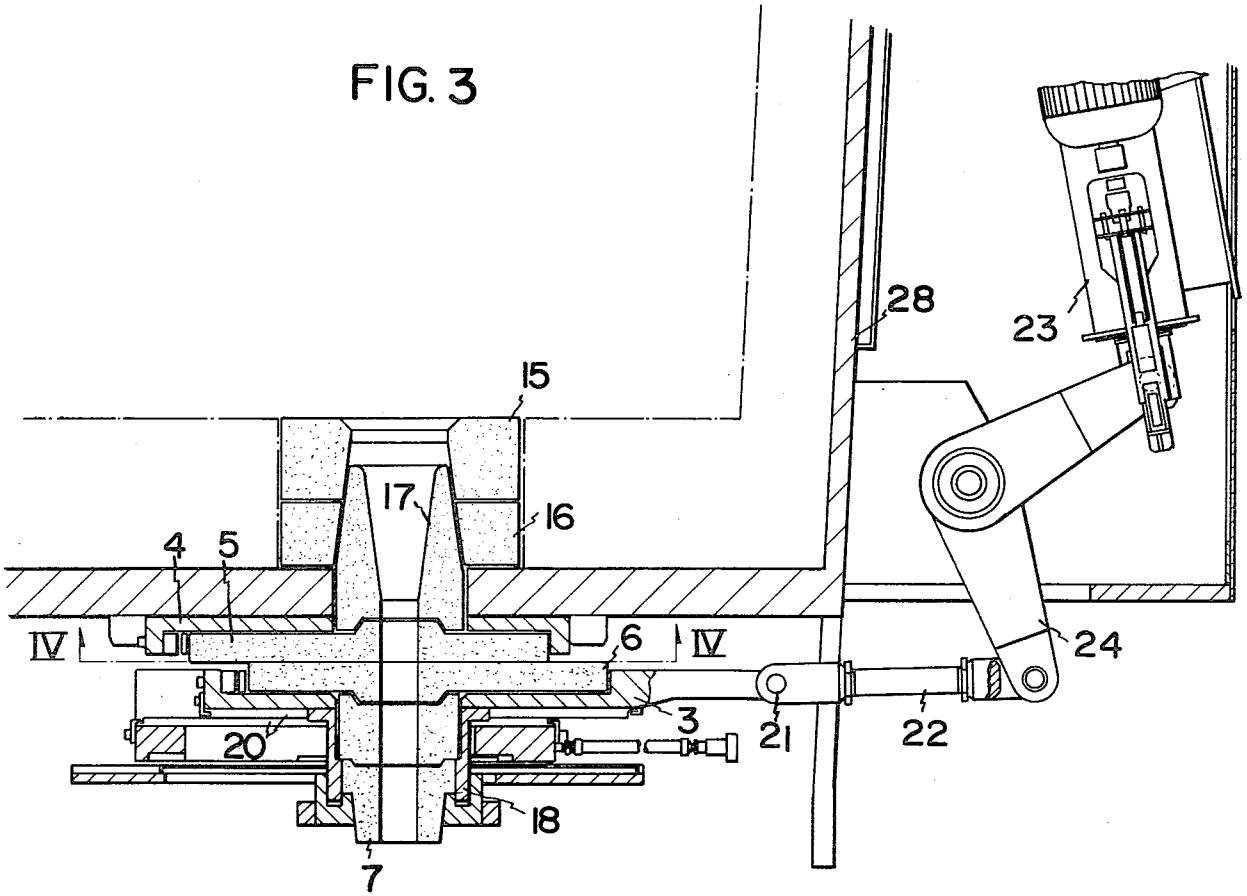
FIG. 3 is a longitudinal cross sectional view of a sliding nozzle of the first embodiment showing a present invention.
Figure 4:
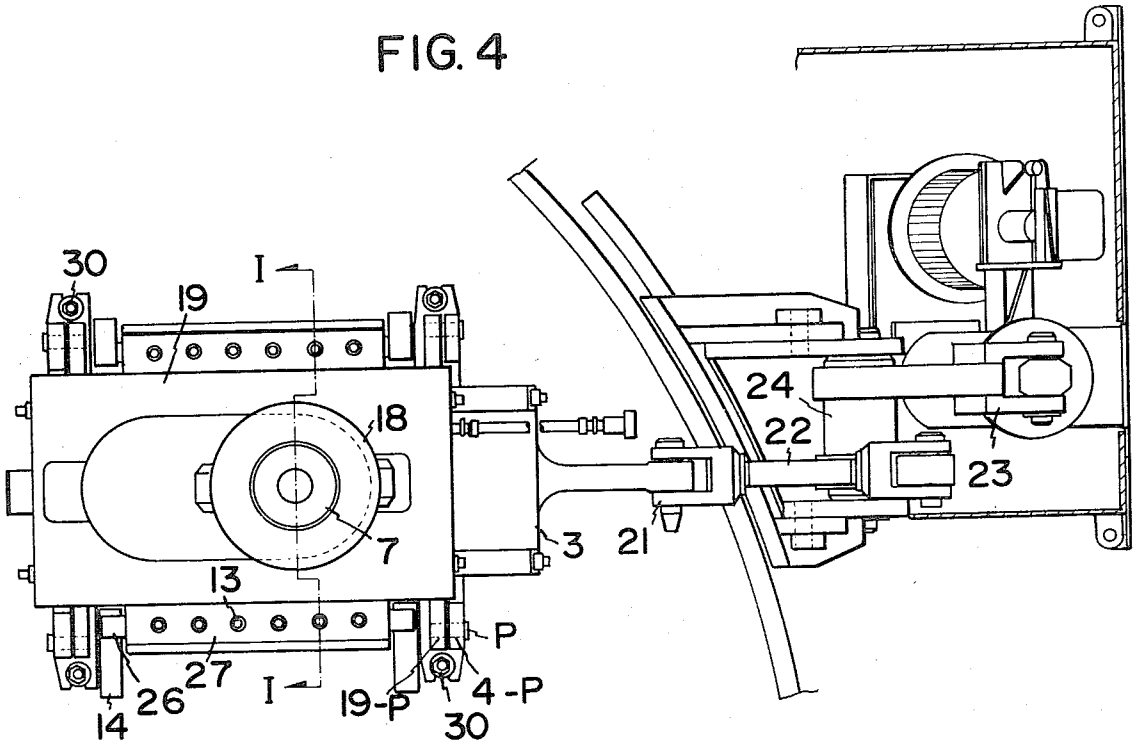
FIG. 4 is a bottom plan view of the sliding nozzle of FIG. 3.
Figure 5:
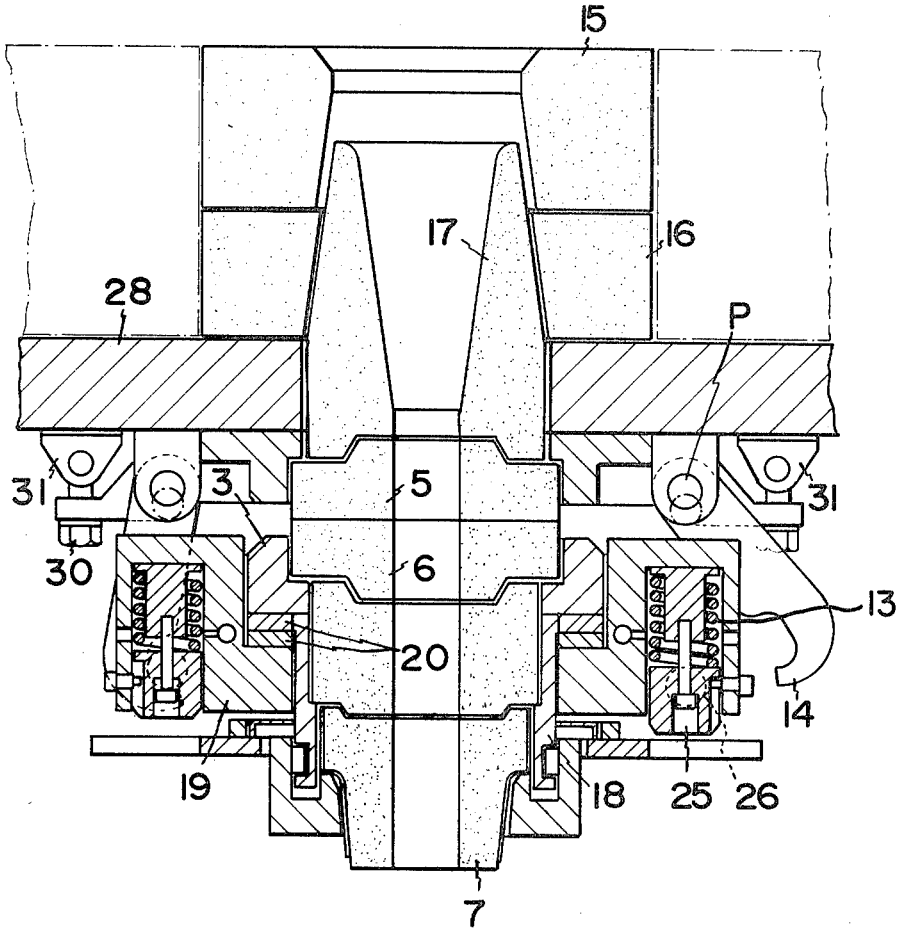
FIG. 5 is a transverse cross sectional view taken along the line I—I of FIG. 4.
Figure 6:
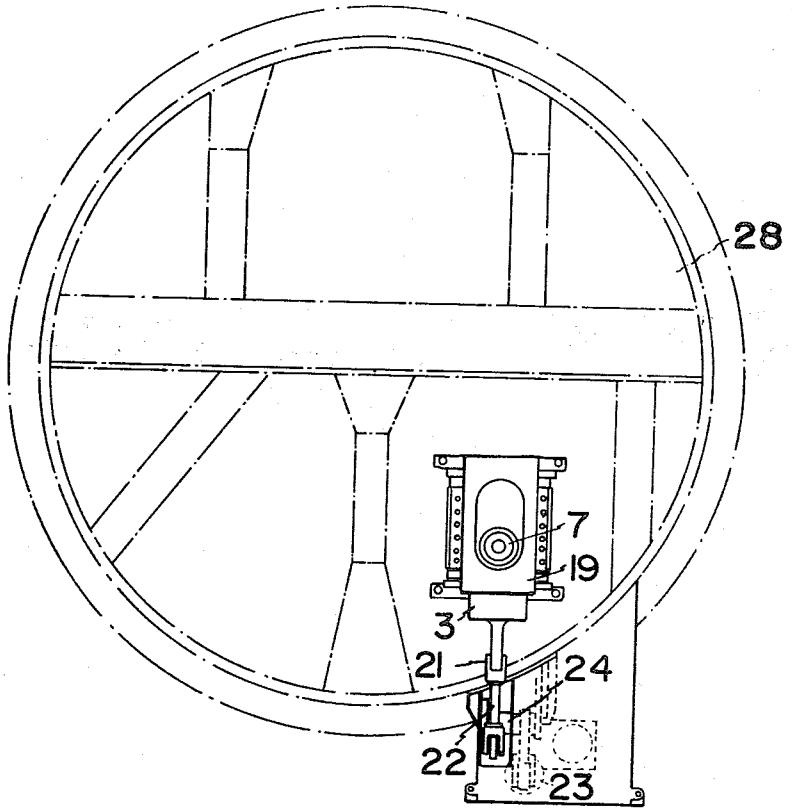
FIG. 6 is a bottom plan view of a ladle vessel on which the sliding nozzle of FIG. 3 is mounted.

In FIG. 2, a press means 12 is shown as being installed in a vertial or upright position. It is to be noted, however, that press means 12 can be installed in a horizontal position when the ladle vessel is disposed horizontally.

As spring means 13, coil springs, flat springs, torsion bar springs or the like can be utilized.

Although arms 8 and 11 have one opening 9 and 10 respectively, the number of openings can be increased when the distance between lower metal frame 1 and spring holding plate 25 varies due to changes in the shape or thickness of elements (3,4,5,6 & 7) which constitute the sliding nozzle and the type of spring means 13 employed. As for the retaining shaft 14 (retaining means) for connecting arms 8 and 11, (which are inserted into openings 9 and 10), pins, including cotter pins, bolts, latch means and the like can be used.

As has been described heretofore, all of the elements which constitute the sliding nozzle are first mounted between the fixed metal frame 4 and spring holding plate 25. Then the spring holding plate 25 is urged toward fixed metal frame 4 by means of press means 12 until openings 9 of arms 8 come into alignment with openings 10 of arms 11.

Subsequently retaining shafts 14 are inserted through the above openings. In this way the sliding nozzle is easily and completely assembled.

Furthermore, the desired sealing pressure between stationary refractory plate 5 and sliding refractory plate 6 can be obtained with great accuracy and safety resulting in the promptness and easiness of the entire setting operation. FIG. 1 shows a conventional sliding nozzle and FIG. 2 shows a sliding nozzle of the present invention.

The method and apparatus of the first embodiment of this invention are hereinafter described in greater detail.

FIRST EMBODIMENT

In the attached drawings, numeral 15 indicates an upper refractory tuyere, numeral 16 indicates a lower refractory tuyere, numeral 5 indicates a fixed refractory plate, numeral 6 indicates a sliding refractory plate, and numeral 7 indicates a pouring nozzle which regulates the flow of the molten metal and which prevents molten metal from splashing. The lower portion of the pouring nozzle 7 is replaceable and forms a part of this invention.

Numeral 4 indicates a fixed metal frame into which stationary refractory plate 5 is fixedly encased. This fixed metal frame 4 is fixedly but removably secured to the bottom of the ladle vessel 28 by engaging a bolt 30 pivotally connected to the bottom of the ladle vessel 28 with an extended bracket formed at each of the four corners of fixed metal frame 4.

Numeral 3 indicates a sliding metal frame onto which sliding refractory plate 6 is mounted.

Pouring nozzle 7 is replaceably mounted on sliding metal frame 3 by a bayonet joint such that the top portion of pouring nozzle 7 is in close contact with the lower protruding portion of the sliding refractory plate 6.

Numeral 19 is a closure metal frame which slidably mounts sliding metal frame 3 on a liner 20 thereof and serves as a guide means for the sliding movement of metal frame 3.

Numeral 21 indicates a yoke, numeral 22 indicates a connecting rod, numeral 23 indicates a power-operated cylinder and numeral 24 indicates an L-shaped pivotable lever such as a bell crank which pivots upon the actuation of power-operated cylinder 23 to effect reciprocating movement of sliding metal frame 3.

By the above power-operated drive means which consists of elements 21 through 24, sliding metal frame 3 is reciprocated longitudinally so as to regulate the flow of molten metal in such a way that the pour opening of sliding refractory plate 6 is brought into alignment with the pour opening of fixed refractory plate 5 in during pouring operation and is shifted out of alignment to thereby close the opening in the sealing operation.

The above mentioned closure metal frame 19 is suspended from fixed metal frame 4 by inserting pins P into respective pin holes 19-P formed at the four corners of closure metal frame 19 and holes 4-P formed at the four corners of fixed metal frame 4 after aligning these holes with each other.

Springs 13 are provided in spaced parallel relation on both sides of the sliding metal frame 3 in the direction of movement of sliding metal frame 3. These springs 13 are encased in a spring box 27 which is provided with spring receiving means and a lateral protruding shaft 26 at both longitudinal ends thereof. These shafts 26 are adapted to be engaged by retaining hooks 14 which are pivotally or swingably attached to the four corners of fixed metal frame 4. Beneath these two spring boxes, the spring holding plate 25 is provided to compress the springs for the purpose of applying the desired sealing pressure between the refractory plates.

Both of or one of pin holes 19-P and 4-P have an enlongated shape to accommodate a range of distances between fixed metal frame 4 and closure metal frame 19 which may be caused by the application and withdrawal of sealing pressure between the refractory plates.

In the apparatus of this embodiment closure metal frame 19 is suspended from fixed metal frame 4 by pins P when the hook means (retainer) 14 are not engaged with protruding shafts 26.

In this case if the pins P disposed on one side of the apparatus are withdrawn, closure metal frame 19 opens relative to the sliding direction of sliding metal frame 3 pivoting on the remaining pins on the other side of the apparatus so that the refractory plates can be replaced. The method of this invention is thus applicable to swinging-type sliding nozzles which will be described later and are shown in FIG. 43 through FIG. 48.

The sealing operation is conducted such that the hydraulic press means 12 is actuated upwards so as to urgingly raise spring holding plate 25 until the desired sealing pressure is obtained between fixed refractory plate 5 and sliding refractory plate 6. Subsequently hook means 14 are engaged with protruding shafts 26 so as to maintain the sealing pressure. (Refer to FIGS. 1 through 5.)

SECOND EMBODIMENT (Pressure Measuring Type)

This embodiment utilizes fluid pressure drive means or electric drive means for applying the sealing pressure.

In this embodiment fluid pressure drive means may be actuated either pneumatically or hydraulically and the force developed is converted into a sealing pressure between the refractory plates by way of a link arrangement, a lever mechanism or a screw mechanism.

The fluid pressure drive means are provided with guage means which indicate a pressure value.

The sealing pressure applying means can be classified as follows:

(1) hydraulically or pneumatically operated means such as rotary actuators which move in a straight line,
(2) a combination of the above fluid pressure drive means and a booster means consisting of links or levers which magnifies the force of the drive means,
(3) a combination of the above hydraulic or pneumatic means and a screw means, and
(4) a combination of electric motor means and screw means.

One of the important considerations in applying a sealing pressure between the refractory plates is that the means employed must be able to apply the proper or appropriate sealing pressure between the refractory plates.

When the sealing pressure is too strong, the device used to reciprocate the sliding refractory plate requires a considerable force and thus becomes unnecessarily large whereas when the sealing pressure is too small, leakage of molten metal through the interfaces of the refractory plates occurs and constitutes a fatal defect of the sliding nozzle.

Accordingly, for the purpose of achieving and maintaining the appropriate sealing pressure, the sealing pressure applying device is provided with a suitable pressure regulating means which indicates the sealing pressure value and wherein a relief valve or a reducing valve can be employed in the fluid pressure drive means while a torque limiter can be employed in the electric drive means.

By the above mentioned regulating or indicating means, a desired sealing pressure is applied between the refractory plates, namely the stationary refractory and sliding refractory plates. After the above operation the upper metal frame which encases the stationary refractory plate and the lower metal frame which encases the sliding refractory plate are rigidly connected by conventional retaining means such as hook means, nuts and bolts, or pins so as to maintain the above sealing pressure between the refractory plates.

The method and apparatus for applying the sealing pressure of this second embodiment have been briefly described heretofore, and are now described in greater detail in conjunction with the attached drawings.

The method is characterized in that the lower metal frame of the sliding nozzle is urgingly raised toward the fixed upper metal frame through the interpositioning of elastic means (such as springs) until a desired sealing pressure, which can be read by a suitable measuring instrument is applied between the refractory plates. Subsequently the lower metal frame is rigidly fastened in position relative to the upper metal frame so as to maintain the sealing pressure whereby an optimal sealing pressure can be achieved directly by mechanical means with promptness and precision.

It is needless to say that this method for applying a desired sealing pressure is applicable to other types of sliding nozzles including rotary types regardless of the position of the vessels.

The device for applying the sealing pressure can be constructed as either an independent or an integral part of the sliding nozzle device.

As devices for applying the sealing pressure, which facilitates the easy reading and regulation of the pressure developed the following devices can be considered such as;

(1) hydraulic or pneumatic devices such as hydraulic jacks,
(2) electric drive devices such as electric linear actuators,
(3) purely mechanical devices.

When fluid pressure devices are employed hydraulic pressure gauges are used for reading the pressure. A resistance wire strain gauge, magnet strain gauge, or spring type of gauge can also be used for reading the pressure exerted by the device for applying the sealing pressure.

In this embodiment, a desired number of the above drive devices can be arranged below the sliding nozzle in the desired positions. FIGS. 6 through 9 show the sliding nozzle of this second embodiment.

The sliding nozzle of this embodiment and the conventional sliding nozzles share the same construction in that stationary refractory plate 5 is fixedly secured to the bottom of vessel 28 by means of fixed metal frame 4, and sliding refractory plate 6 is slidably mounted on a lower support plate 2 by means of sliding metal frame 3. Lower support plate 2 is supported by retaining bolts 14 which are suspended from fixed metal frame 4.

However, in this embodiment, in view of the relationship between lower support plate 2 and the retaining bolts 14, a number of compression coil springs 13 are disposed beneath the lower support frame 2 in a dynamically balanced distribution and these springs 13 are supported by spring holding plate 25. Plate 25 is suspended from fixed metal frame 4 by means of support bolts 14 which are provided with nuts 29 which eventually support the spring holding plates.

The above mentioned sliding nozzle devices are so called cassette-type devices and can be easily and rapidly mounted onto the bottom of the vessel by threading the bolts 30 therein. The sealing pressure is not still applied between the refractory plates at this stage.

As a means or device for applying a sealing pressure, a U-shaped arm 32 is provided and has one end pivotally secured by a pin 33 to a bracket which is fixedly secured to the bottom of vessel 28 such that the U-shaped portion of the arm 32 swingably encloses the lower end of the sliding nozzle device. The outer free end of U-shaped arm 32 is bent at a 90° angle relative to each upright portion therefore thereby forming a horizontal extension **32*a* thereof. This portion 32*a*** is employed for applying the sealing pressure in cooperation with the hydraulic press means which is described hreinafter.

Numeral 34 indicates a retaining lug which is fixedly secured to a portion of the bottom of vessel 28 toward which extension **32*a*** is raised upwardly by hydraulic pressure means.

Hydraulic press means consists of a hanger means 35 which has a hook portion **35*a* thereof insertable into retaining lug 34 and a hydraulic cylinder 36 which presses against the lower surface of the extension 32*a* urging it toward retaining lug 34**.

Figure 7:
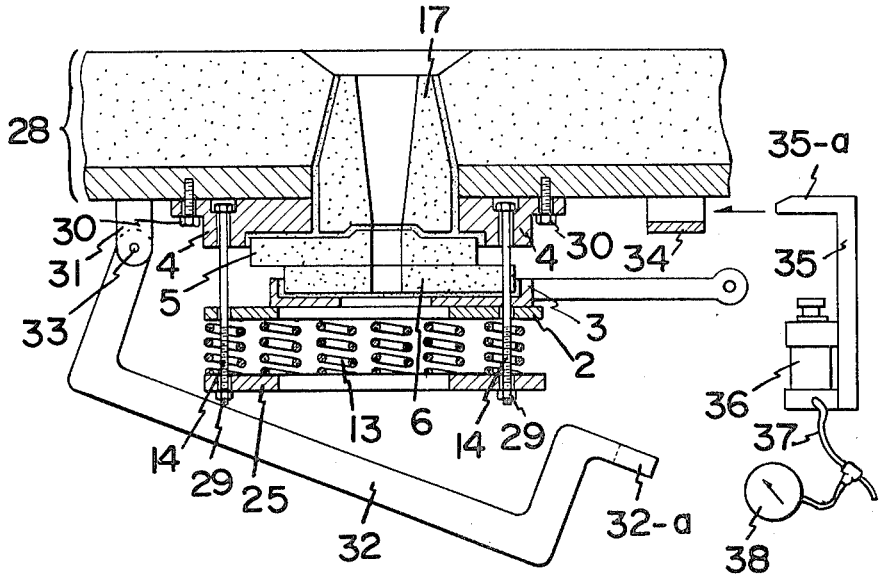
FIG. 7 is a longitudinal cross sectional view of a sliding nozzle constituting a second embodiment of the present invention in which a hydraulic cylinder is employed but is shown in its unconnected condition.

The operation to apply an interface sealing pressure between the stationary and sliding refractory plates is conducted with reference to a way described in FIG. 7 wherein arm 32 is pivotally swung upwardly on pivot pins 33 such that the flat portion of arm 32 comes in contact with the lower portion of the sliding nozzle device. Subsequently the hydraulic press means is attached to vessel 28 by inserting hook portion **35*a* into retaining lug 34 and the actuating rod hydraulic cylinder 36 is aligned with extension 32*a***.

The operation to apply a sealing pressure is conducted by actuating hydraulic cylinder 36 while reading a hydraulic pressure in a pressure gauge 38 interposed in hydraulic line 37.

Setting and adjustment of the sealing pressure is conducted such that the optimal pressure is determined in view of the data obtained from the past records of the setting operations.

Figure 9:
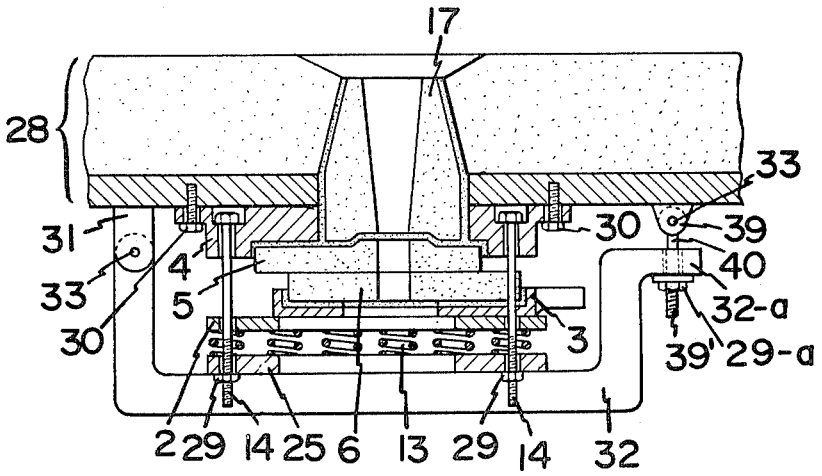
FIG. 9 is a view similar to FIG. 8 but showing the sliding nozzle provided with fastening bolt means which is secured to the bottom plate of a ladle vessel.
Figure 10:
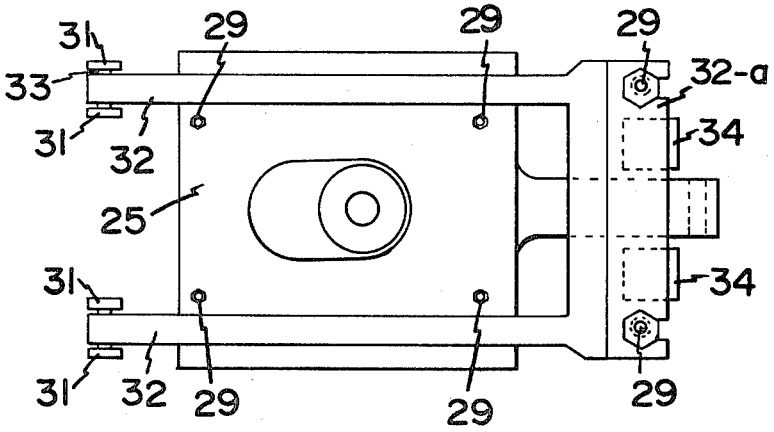
FIG. 10 is a bottom plan view of the sliding nozzle arrangement of FIG. 9.

The arm 32 can be maintained in a pressure-applied stage by hydraulic cylinder 36 even during the running of the furance and, if desired, arm 32 can be completely fixed by nuts 29 and bolt means 14 as shown in FIGS. 9 and 10.

Figure 8:
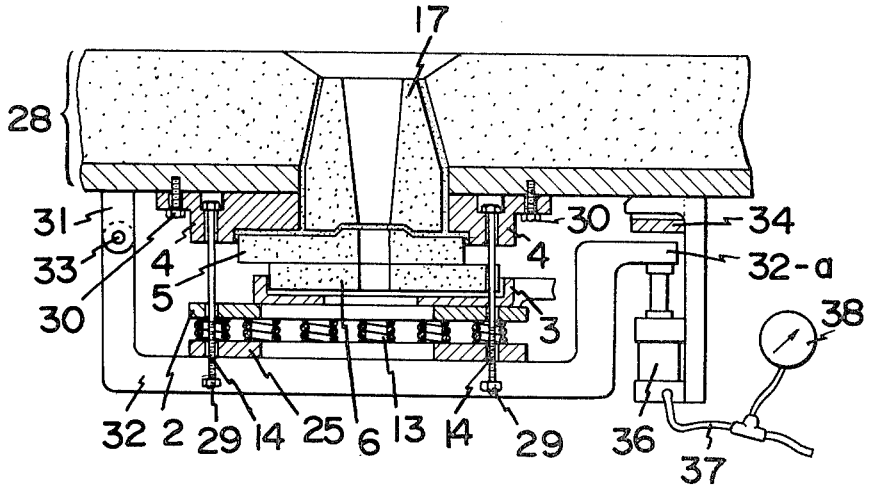
FIG. 8 is a view similar to FIG. 7 but showing the hydraulic cylinder in its operative condition.

FIGS. 8 and 9 show the sliding nozzle in the above condition where the operation to apply the sealing pressure is completed by nuts 29 and bolt means 14.

A support bracket 39 is further fixedly secured to the bottom of vessel 28 at a position in alignment with the movement of the extension 32*a*. An eye bolt is suspended from bracket 39 by rotatably connecting the ring portion thereof to the bracket 39. After the flat portion of U-shaped arm 32 is raised and disposed parallel to the surface of the bottom of the vessel so as to apply a desired sealing pressure between the refractory plates, nuts 29*a* are threaded on the eye bolt so as to fix U-shaped arm 32 in place.

It is preferable that the fastening of nuts 29 and 29*a* be conducted by a torque wrench while the sliding nozzle is subject to the sealing pressure by hydraulic cylinder 36.

After the desired elements of the device are fixedly fastened and secured, the hydraulic cylinder 36 is retracted and hanger means 35 is removed.

Figure 11:
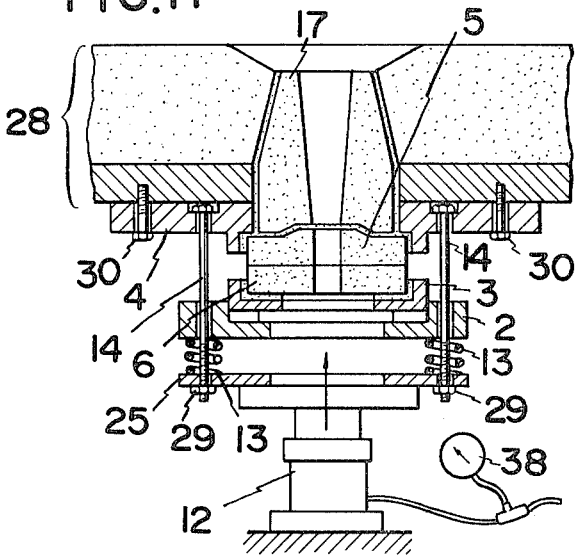
FIG. 11 is a transverse cross sectional view of a modification of the sliding nozzle of the second embodiment wherein the hydraulic cylinder is not yet activated.
Figure 12:
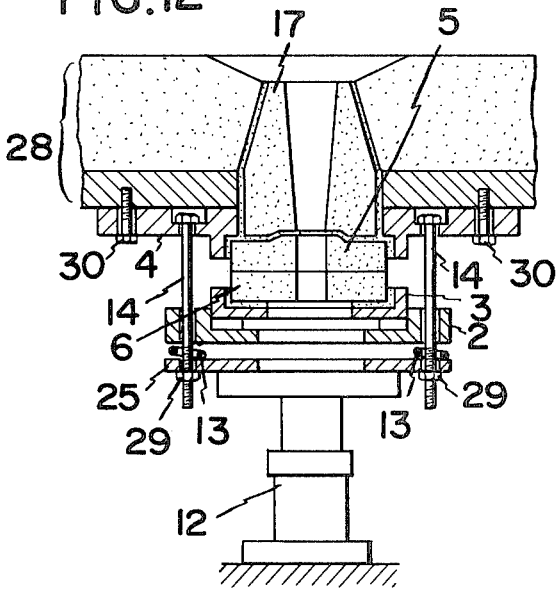
FIG. 12 is a view similar to FIG. 11 but showing the hydraulic cylinder in operation.

FIGS. 11 and 12 show a modification of this embodiment wherein the sliding nozzle has almost the same construction as that described with the exception that spring holding plate 25 is directly pressed by press means 12 which is mounted on the ground or on any other rigid supporting structure.

In this modification, the pressing force exerted when press means 12 is actuated can be read also by pressure gauge 38 which facilitates the correct setting of the optimal sealing pressure between the refractory plates. In the pressure loaded condition, nuts 29 are threaded onto retaining bolts 14 with the optimal torque whereby the setting operation is completed.

Figure 13:
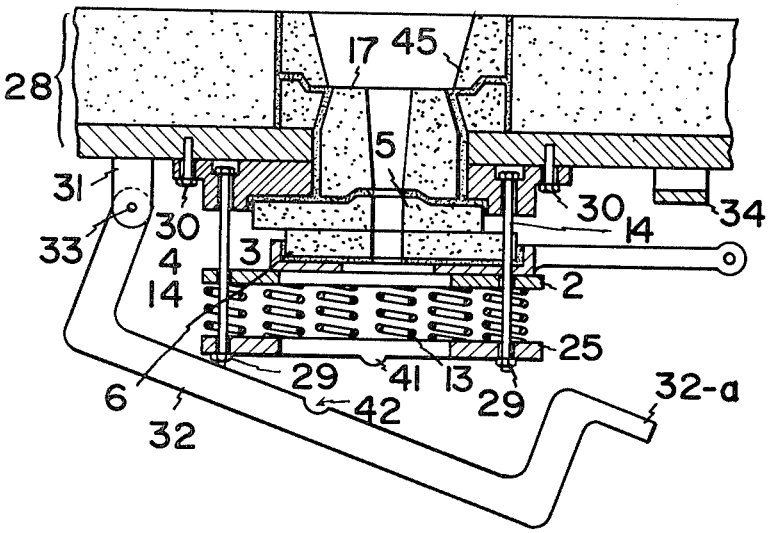
FIG. 13 is a longitudinal cross sectional view of a further modification of the sliding nozzle of the second embodiment.

FIG. 13 indicates another modification wherein the sliding nozzle device has substantially the same construction as that of the previous-mentioned sliding nozzle of this embodiment.

In this modification, a downward protrusion 41 is formed in the central part of spring holding plate 25, and a recess 42 is formed in U-shaped arm 32 at a location thereof such that protrusion 41 rests within recess 42 when the sealing operation is completed whereby the sealing operation can be conducted more quickly and with greater precision.

FIG. 13 shows a still another modification of this embodiment.

In this modification, however, sliding refractory plate 6 and lower refractory nozzle 7 are both encased within sliding metal frame 3 and furthermore a plurality of compression coil springs 13 are disposed between the sliding metal frame 3 and sliding metal shield 43.

Figure 14:
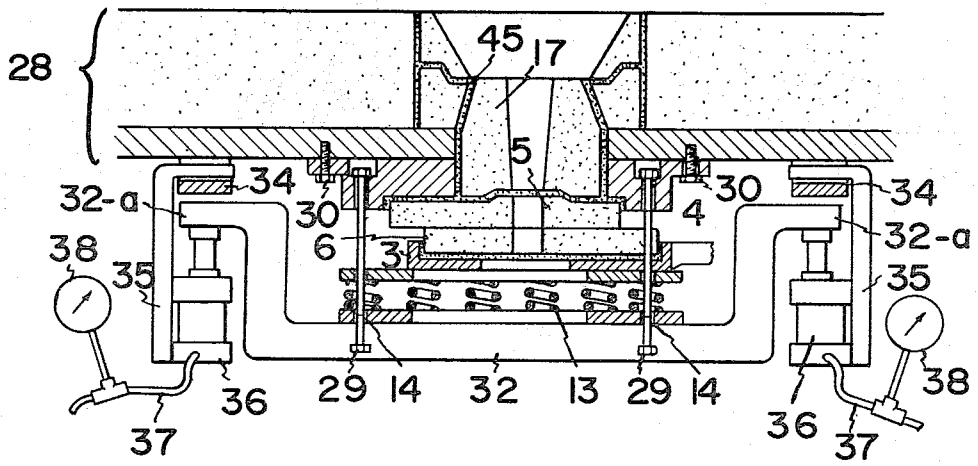
FIG. 14 is a longitudinal cross sectional view of yet another modification of a sliding nozzle of the second embodiment wherein two hydraulic cylinders are employed at respective longitudinal sides of the sliding nozzle.

This modification is characterized in that the spaced apart round and upward protrusion 41*a* are formed to U-shaped arm 32 which support the sliding nozzle device from the bottom and those protrusion 41*a* uniformly press sliding metal frame 3 by way of springs 13 whereby the surface of sliding refractory plate 6 is uniformly pressed onto the corresponding surface of stationary refractory plate 5. FIG. 14 shows a further modification of this embodiment which is also constructed following the principle applied to the previously described sliding nozzle of this embodiment. Specifically horizontal extensions 32*a* are formed at both ends of U-shaped arm 32 and are adapted to be pressed upwardly by a pair of hydraulic devices for applying the sealing pressure, each of which hydraulic devices consists of hanger means 35 and the hydraulic cylinder 36. Advantages of this embodiment:

According to the aforementioned embodiments, since the setting and regulation of the sealing pressure is conducted while checking the value which appears on the pressure gauge, data processing can be conducted after collecting the data on the above sealing pressure.

In the method of this invention, since the operation to apply an optimal sealing pressure between the refractory plates is conducted each time that the sliding nozzle device is mounted onto the bottom of a ladle vessel, the sealing operation is not substantially affected by the wear or distortions of the elements such as the refractory plates. Elements having some variations in sizes can be used to nevertheless provide a desired sealing pressure between refractory plates. When the pouring operation is conducted while the device for applying a sealing pressure is in operation at the bottom of the vessel, the compression coil springs and the hydraulic cylinder can work cooperatively so that the establishment of the sealing pressure between the refractory plates can be conducted while reading the pressure gauge even during the above pouring operation whereby the optimal sealing pressure can be maintained and regulated throughout the pouring operation.

Accordingly, proper measures can be accurately and promptly taken when an accident or a change working conditions occurs.

Furthermore, valuable data which is the accumulation of pressure values measured and obtained at the operation site is systematically analyzed and monitored and the thus processed result is fedback to the operation site for use in the setting of the optimal sealing pressure between the refractory plates.

In this way, operational standards can be fully utilized by the method of this invention and can also be improved.

On the basis of the thus improved operational standards the sliding nozzle device and the operation to conduct the sliding nozzle device can be further improved so as to achieve optimal pouring operations for molten metal from a ladle vessel or the like.

As a modification of elements which can be used in the sliding nozzles disclosed in both the described first and second embodiments, vessel 28 which is described as a molten metal container, has an outer metal shell and has secured to the bottom thereof a base plate. The sliding nozzle is fixedly mounted on such base plate in such a way that the fixed metal frame 4 thereof is fixedly but replaceably secured to the base plate by means of bolts.

Stationary refractory plate 5 and sliding refractory plate 6 are disposed between the fixed metal frame 4 and sliding metal frame 3. Stationary refractory plate 6 has its central boss portion thereof disposed within a socket formed at the lower end of upper refractory nozzle 17. The refractory tuyere of this device is divided into upper and lower parts 15 and 16 thereof wherein the material of upper part 15 is preferably zircon or a zirconium compound (zirconia) which displays high thermal-wear resistance because upper part 15 is directly subject to molten metal while the power part 16 thereof is preferably made of lower-class material such as fireclay brick.

High thermal-wear resistant material such as corundum, zircon or zirconia can be considered as material for refractory nozzle 17.

Figure 36:
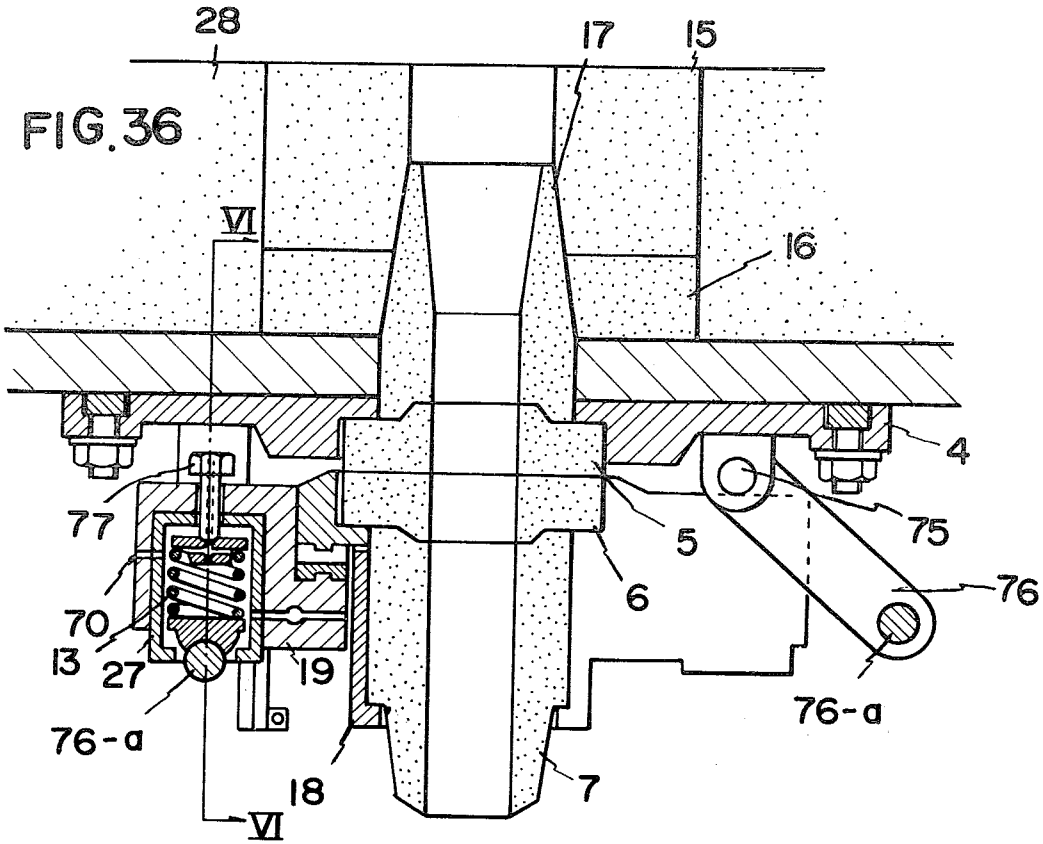
FIG. 36 is a transverse cross sectional view of a sliding nozzle of this invention wherein a modification of the spring means of FIG. 33 is shown in detail.
Figure 37:
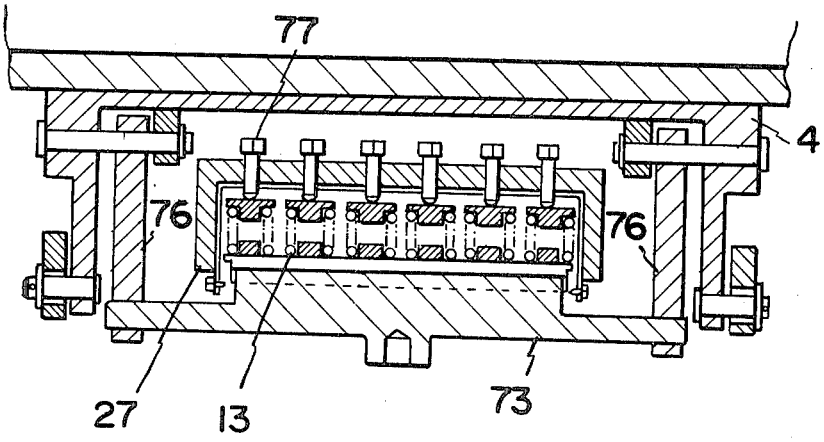
FIG. 37 is a cross sectional view taken along line VI—VI of FIG. 36.
Figure 38:
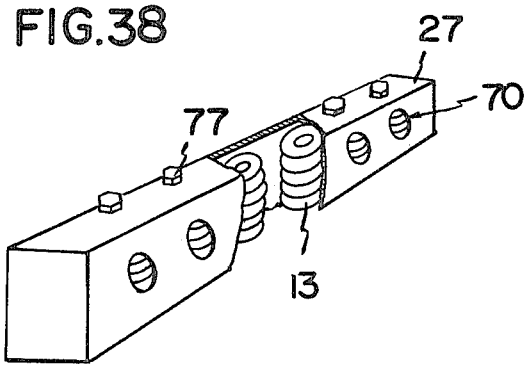
FIG. 38 is a perspective view partially broken away of a spring encasing box employed with the sliding nozzle of FIG. 36.
Figure 39:
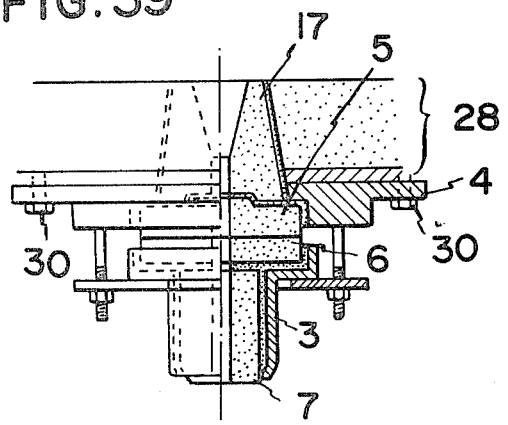
FIG. 39 is a transverse cross sectional view of a conventional sliding nozzle wherein the pouring nozzle is a unitary member.

In the assembled construction of the upper portion of the sliding nozzle as shown in FIG. 36 which is formed by upper refractory nozzle 17 and the refractory tuyere, the refractory tuyere is divided into upper and lower refractory tuyeres 15 and 16 and the upper end surface of upper refractory nozzle 17, as described heretofore, extends above the lowermost end surface upper refractory tuyere wherein upper refractory tuyere 15 works as a front nozzle.

In this way, by separating the refractory tuyere into two parts, namely upper and lower parts thereof, the following advantages can be brought about wherein the upper refractory nozzle 17 can be of a small size and the refractory tuyeres 15 and 16 can also be of small size whereby these parts of the device which are in general considerably heavy can be easily handled and transferred. Furthermore, the refractory pouring nozzle 7 may also desirably be divided into two parts wherein the upper part of the nozzle 7 has substantially the same operational longevity as the refractory plate while the lower part thereof is replaceable at each charge FIG. 3, for example, illustrates such a multi-component pouring nozzle 7.

In this case, since the wear rate of the lower part of the refractory pouring nozzle, in general, is higher at the outlet portion than other portions thereof, the lower part should preferably be constructed of a good wear-resistant material.

However, when the lower part is made of a high wear-resistant material, it causes the clogging of the opening while when the lower part is made of a low wear-resistant material, the life of the pouring nozzle is far shorter than the life of the refractory plate so that nozzle 7 must be replaced after one or two charges.

However, when the entire lower refractory pouring nozzle must be replaced, the refractory plate, which is made of wear-resistant material, is subject to cool air which results in cracks or peeling thereof due to thermal spalling and the plate becomes no longer useable. Therefore, as has been described heretofore, the lower refractory nozzle is preferably divided into upper and lower sections thereof wherein the upper section is made of the same material as that of the refractory plate such as corumdum, high alumina or zircon while the lower section is made of a low wear-resistant material such as a compound of zircon and silica or chamotte.

Furthermore, since the lower refractory pouring nozzle is made of two separate sections, the life thereof is highly extended, and the diameter of the nozzle can be varied so as to regulate the flow of pouring molten metal.

The lower pouring nozzle preferably is enclosed by a metal shield 18 or wires on the outer periphery thereof.

Referring now to the refractory plates, since they are used in very severe working conditions, they require improved performances such as high friction resistance. Therefore, corundum, high alumina, zircon, zirconia and basic materials such as magnesia, magnesia-chrom or a composite of the above materials can be considered as material for the refractory plate.

For the purpose of preventing the occurrence or the development of cracks on or within the refractory plate during severe working conditions, a metal hoop, wires or a steel band is wound around the periphery of the plate at least once around.

Due to this encircled band, the refractory plate can be easily replaced without breaking down even after many cracks have occured in the plate resulting in improved efficiency in the replacing of the plates.

Each essential feature of the invention is hearafter described in greater detail with reference to the attached drawings.

(1) Cassetting of the Sliding Nozzle

The operation to mount a sliding nozzle onto a vessel is generally conducted under adverse conditions where the temperature is extremely high and, therefore, the operators must face severe working conditions and also the sliding nozzle is adversely-affected.

Figure 16:
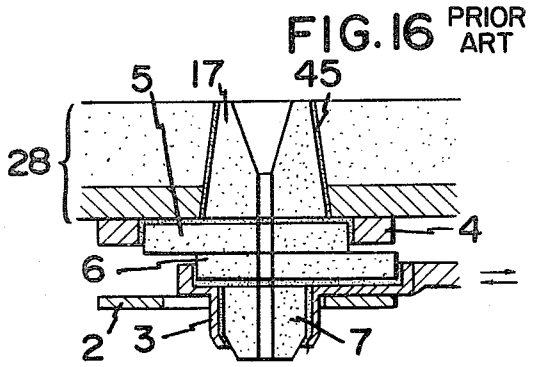
FIG. 16 PRIOR ART
FIG. 16 is a longitudinal cross sectional view taken along line II—II of FIG. 15.
Figure 15:
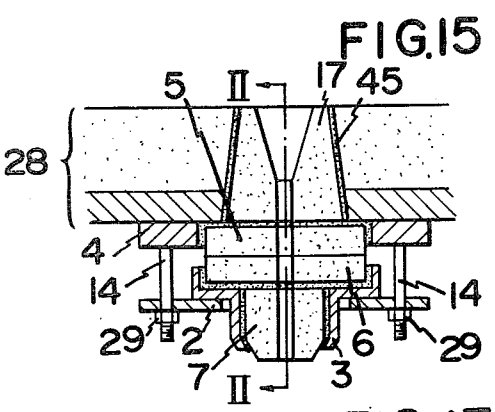
FIG. 15 PRIOR ART
FIG. 15 is a transverse cross sectional view of a conventional sliding nozzle which is to be compared with a "cassette-type" sliding nozzle of this invention which is shown in FIG. 17 through FIG. 23.

For the purpose of mounting the sliding nozzle even under the above adverse conditions, the stationary refractory plate, the sliding refractory plate, the lower refractory pouring nozzle and the associated metal frames or fittings which assemble and fasten the above respective elements of the sliding nozzle must be prepared with great care and deliberation and are assembled in a precise and sequential order. In the above assembling operation, as can be observed from FIGS. 15 and 16, conventional mortar 45 is first pasted around the outer periphery of upper refractory nozzle 17 as an adhesive agent, and then nozzle 17 is inserted upwardly into the opening formed in the bottom of vessel 28 and fixed therein. Subsequently, mortar 45 is pasted onto the top surface of stationary refractory plate 5 and the mortar-applied surface of the refractory plate 5 is fixedly adhered to the surface of the lower end of upper refractory nozzle 17.

Then sliding refractory plate 6, which before-hand is set within sliding metal frame 3 by mortar 45, has the upper surface thereof precisely contacted and mated with the lower surface of stationary refractory plate 5.

After the above assembling operation, sliding metal frame 3 is positioned onto lower metal support plate 2 and subsequently is fixedly secured by retaining bolts 14 whereby the sliding nozzle is completely assembled and mounted onto the bottom of vessel V.

In this way, the conventional mounting operation of the sliding nozzle is troublesome and time consuming and requires difficult mounting techniques.

Furthermore, it must be noted that when the assembly and mounting of the sliding nozzle is completed, the operation for the application of sealing pressure between stationary refractory plate 5 and sliding refractory plate 6 must be adjusted by merely fastening retaining bolts 14 which pass through lower metal plate 2 and keeps the position of plate 2 relative to fixed metal frame 4.

The above operation to apply sealing pressure between the refractory plates, in general, requires an adjustment of high deliberation and precision because when the sealing pressure is too strong, the stationary refractory plate and the sliding refractory plate are both subject to high frictional wear, and the drive means for reciprocating the sliding refractory plate requires a sliding force far greater than the force necessary when the proper sealing pressure is applied. When the sealing pressure is too weak, molten metal infiltrates between the contiguous surfaces of the refractory plates during the sliding operation for regulating pouring of the molten metal so that either the sliding of the refractory plate becomes no longer possible or fracture of the refractories occurs.

The regulation of the sealing pressure which must be conducted properly at any time corresponding to the change of various conditions, including conditions related to the vessel, is therefore very important in the manipulation of the sliding nozzle.

This invention discloses a casette-type sliding nozzle device which was developed in view of the above-mentioned problems which are characteristic of conventional methods, wherein the device of the invention facilitates the easy and rapid mounting of the sliding nozzle onto the bottom of the vessel and affords optimal adjustment of the sealing pressure between the refractory plates.

In order to clarify the showing of the sliding nozzle and to simplify description of the construction of the cassette sliding nozzle structure the spring means mounted on the sliding nozzle are not shown in FIG. 17 through FIG. 22.

Figure 19:
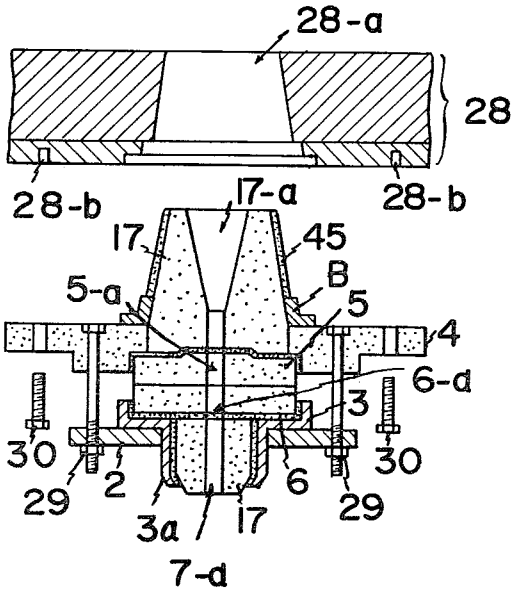
FIG. 19 is a view similar to FIG. 17 but showing the cassette-type sliding nozzle before it is mounted onto the bottom of the ladle vessel.

As shown clearly in FIG. 19, upper refractory nozzle 17 has a substantially frustoconical shape and is provided with an opening 17*a* which passes through the center of the nozzle in an axial direction.

This upper refractory nozzle 17 is constructed in the above way and has the outer periphery thereof pasted with mortar so that it can be later in a final stage of mounting operation promptly inserted into an opening 28*a* formed previously in the bottom of vessel 28 and to fit tightly therein.

It is noted that the shape and size of opening 28*a* and of sliding nozzle 17 must be predetermined in view of the above pasting of the mortar 45.

To the lower outer periphery of upper refractory nozzle 17, a sleeve B is fixedly secured and this sleeve B is further fixedly fastened by bolt means onto fixed metal frame 4 which snugly encloses the lower flat portion of upper refractory nozzle 17.

Subsequently stationary refractory plate 5, which is provided with mortar on the upper surface thereof, is urged into contact with the lower surface of upper refractory nozzle 17 and the corresponding recess formed in the lower surface of fixed metal frame 4 such that the three elements are tightly and integrally assembled into one unit.

Numeral 5*a* indicates an opening formed in stationary refractory plate 5 which communicates with opening 17*a* of upper refractory plate 17.

The sliding refractory plate 6 and pouring refractory nozzle 7 are both encased within the sliding metal frame 3 and they are assembled into a rigid unit by applying the mortar 45. In this case, an opening 6*a* formed in sliding refractory plate 6 must be aligned with an opening 7*a* formed in pouring refractory nozzle 7.

Then, cylindrical portion 3*a* of the sliding metal frame 3 is slidably disposed within an elongated opening 46 formed in lower metal plate 2 such that sliding metal support frame 3 can slide on lower metal plate 2 longitudinally with a predetermined stroke along opening 46. The above cylindrical portion 3*a* retains lower refractory pouring nozzle 7.

In the above operation, sliding refractory plate 6 has the upper flat surface thereof correctly and closely positioned adjacent to the lower flat surface of stationary refractory plate 5.

Subsequently by fastening fixed metal frame 4 and lower metal plate 2 by means of high tension nuts 29 and bolts 14, all the above mentioned elements which consistute the sliding nozzle are integrally assembled into a complete cassette.

Of course opening 5*a* of stationary refractory plate 5 and opening 6*a* of sliding refractory plate 6*a* are located such that they are brought into complete alignment so as to communicate with each other at one point within the range of the sliding movement of sliding metal frame 3.

The sealing pressure between stationary refractory plate 5 and sliding refractory plate 6 can be regulated to any desired value by a press means 12 (not shown in FIGS. 19 and 20 of the drawings), and retaining nuts 29.

The above regulating operation can be precisely conducted in a production factory or an assembly plant using high precision instruments and jigs prior to the steps for mounting the sliding nozzle into vessel 28.

Figure 18:
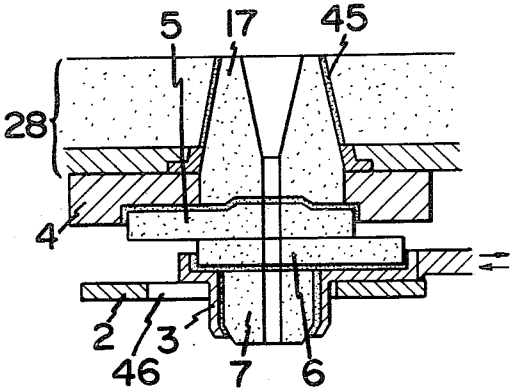
FIG. 18 is a longitudinal cross sectional view taken along line III—III of FIG. 17.
Figure 17:
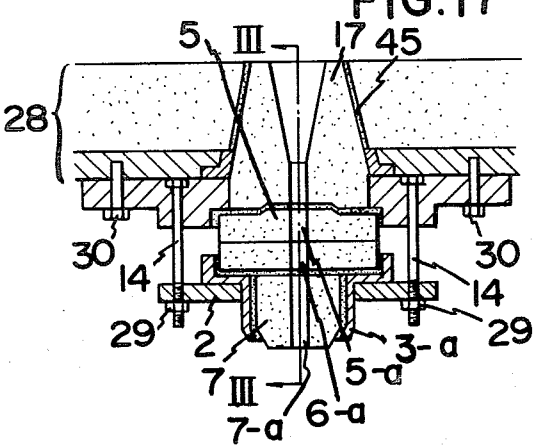
FIG. 17 is a transverse cross sectional view of a cassette type sliding nozzle of this invention which can be rigidly fastened to the bottom of a ladle vessel.
Figure 20:
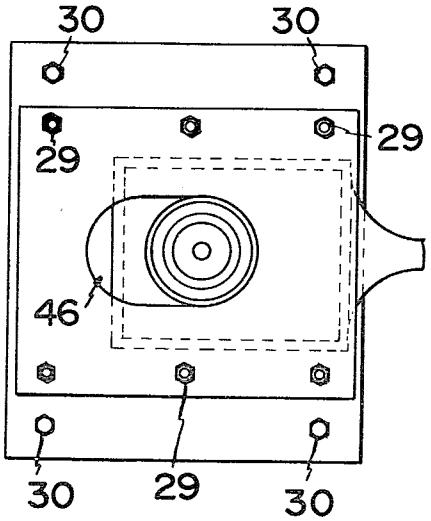
FIG. 20 is a bottom plan view of the cassette-type sliding nozzle in mounted position on the ladle vessel.

The sliding nozzle device which is preassembled as shown in FIG. 19 is mounted onto vessel 28 by merely inserting upper refractory nozzle 17 into opening 28*a* and by fastening fixed metal frame 4 to the bottom of the vessel with bolt means 30 as shown in FIGS. 17 and 18.

Accordingly, in order to mount the sliding nozzle device onto the vessel 28 it is merely necessary to preliminarily form female-threaded holes in the bottom shell of the vessel.

Since the cassette type sliding nozzle device of this invention is substantially composed of upper refractory nozzle 17, stationary refractory plate 5 and the sliding refractory plate 6, the mounting operation can be easily and rapidly conducted with great accuracy such that in using the desired table, such as a working table, mortar 45 is pasted around the outer tapered portion of upper refractory plate 17 and the thus mortared portion is inserted into opening 28*a* of vessel 28 so as to be fixedly secured therein. Subsequently the operation to accurately position the members is conducted, and finally the sliding nozzle device is fixedly secured to the bottom of the vessel by bolt means. Furthermore, since the sealing pressure has already previously been accurately regulated, the sliding nozzle device has a stable and optimal interface sealing pressure and can be mounted onto the bottom of the vessel 28.

Besides the above advantages related to the mounting operation, the operation to remove the worn refractory plate or the like also can be simply and expeditiously conducted.

Furthermore, the provision of the cassette-type sliding nozzle also contributes to improved safety.

This embodiment, as will be appreciated from the foregoing description, is characterized in that the upper refractory nozzle, the stationary refractory plate and the sliding refractory plate are assembled into one unit as a cassette prior to the mounting operation.

The upper refractory nozzle forms an essential part of the sliding nozzle for facilitating the smooth flow of molten metal from the vessel and for providing a lining at the bottom opening of the vessel.

The stationary refractory plate which is produced with a high degree of flatness is essential as an element of the sliding nozzle for preventing the wear of the lower portion of the upper refractory nozzle and for improving the stability of the upper refractory nozzle by avoiding the transfer of direct vibration to the nozzle from the sliding movement of the sliding refractory plate which would otherwise occur if the stationary plate is not employed.

Furthermore, the sliding refractory plate which has a high degree of flatness at the upper sealing surface thereof forms another essential element of the sliding nozzle for achieving smooth sliding relative to the stationary plate.

In this invention, for reinforcing the sealing between the refractory plates, and for easing the troublesome mounting operations to assemble the respective refractories and related fittings in a sequential order, the upper refractory nozzle, the stationary refractory plate and the sliding refractory plate are previously assembled into an integral unit and the upper refractory nozzle is assembled with the other elements by means of sleeve B.

Although sleeve B can be performed as a part of the fixed metal frame, it is preferable that sleeve B be replaceably mounted on the fixed metal frame by bolt means since the stationary fixed metal frame can then be easily replaced, assembled or produced.

Furthermore, when sleeve B is embedded in the fixed metal frame such that it is disposed within the circular recess formed in the upper surface of the fixed metal frame, the bottom of the vessel 28 can be of a simple shape.

Figure 21:
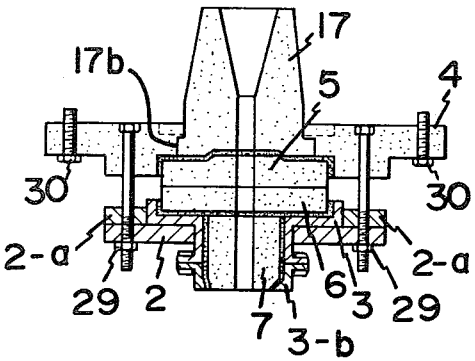
FIG. 21 is a transverse cross sectional view of a modified form of cassette-type sliding nozzle

FIG. 21 shows a modification of the cassette-type sliding nozzle. In FIG. 21, upper refractory nozzle 17 is fixedly mounted onto stationary metal frame 4 such that a flange portion 17*b* formed at the lower end of the upper refractory nozzle 17 is securely disposed within fixed metal frame 4 by a suitable retaining element.

The retaining element which presses flange portion 17*b* into metal frame 4 may be formed as an integral part of metal frame 4 or may comprise a replaceable means as shown in dotted lines. The upper refractory nozzle and the stationary refractory plate are fixedly assembled by mating the upward recess which is formed in the lower end surface of upper refractory nozzle 17 with the upwardly protruding portion of stationary refractory plate 5 so that the sealing therebetween is less damaged whereby the life of the nozzle and plate can be prolonged.

The nozzle 17 and plate 5 can be tightly pre-assembled into one unit as shown in FIG. 21. When the lower cylindrical portion of sliding metal frame 3, which is used for securing the pouring refractory nozzle to sliding refractory plate 6, is provided with a replaceable separate portion 3*b* thereof, replacement or mounting of the lower refractory nozzle 7 is facilitated.

In this modification, apart from the lower metal plate 2, a guide plate 2*a* which brings about the stable sliding movement of sliding metal frame 3, may be employed.

Fixed metal frame 4 can be fastened to the mounting portion of the bottom of the vessel by suitable elements such as pins, cams, screws and the like. The same goes for the retaining means which fastens supporting plates 2 and 2*a* to fixed metal frame 4.

Figure 22:
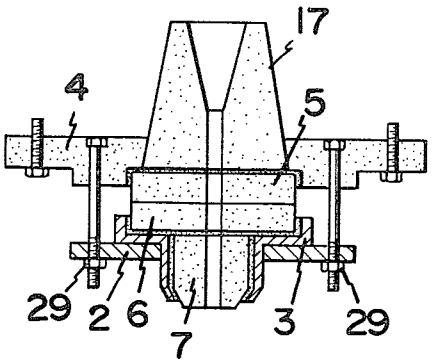
FIG. 22 is a transverse cross sectional view of yet another modification of a cassette-type sliding nozzle.

FIG. 22 shows the third modification of this invention. The construction of the sliding nozzle disclosed in FIG. 22 is similar to that of the first modification shown in FIG. 21. However in this modification, in view of the assembled relationship between upper refractory nozzle 17 and fixed metal frame 4, the lower end of upper refractory nozzle 17 has a frustconical contour and is tightly disposed within the tapered opening formed in fixed metal frame 4.

(2) Referring to the shape of the refractory plate:

This portion of the specification relates to a stationary refractory plate and sliding refractory plate employed in this invention.

It is also directed toward a description of the pouring refractory nozzle and of other suitable refractory plates.

The plates which will be disclosed hereinafter are the stationary refractory plate, the sliding refractory plate or other similar or attached refractories, all of which are encased in the metal frame structure and are fixed at desired positions.

Figure 23:
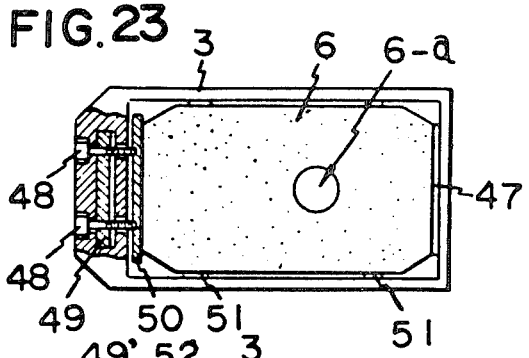
FIG. 23 is a bottom view with a portion partially broken away and in section taken along line IV—IV of FIG. 3 showing the sliding refractory plate of the present invention.
Figure 24:
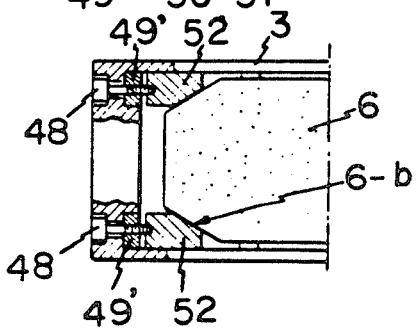
FIG. 24 is a view similar to FIG. 23 but showing a modified fastening means for fastening the sliding refractory plate within a sliding metal frame.

FIGS. 23 and 24 describe the plates of this invention.

In FIG. 23, sliding refractory plate 6 is loosely encased in sliding metal frame 3 as is the plate of a conventional sliding nozzle.

However, within the right hand space formed between one longitudinal end of sliding plate 6 and one inner longitudinal end rib of sliding metal frame 3, a spacer 47 such as an iron plate or a heat-resistant plate is inserted. This spacer 47 plays an important role in the fine adjustment of the nozzle opening or for accommodating the expansion of the sliding refractory plate 6 which occurs due to the rise of temperature. The left hand longitudinal end rib of sliding metal frame 3 has a considerably larger width than that of the right hand end rib and two spaced apart refractory setting bolts 48 pass through openings formed therein in a longitudinal direction and on the same level as that of sliding refractory plate 6. At the center of the above mentioned left hand end rib, a transverse aperture or slit is formed perpendicular to the bolt openings and a block 49 into which the middle portion of the respective bolt is threaded, is disposed loosely within the above transverse aperture. The ends of refractory securing bolts 48 which pass through the bolt openings and which are threaded into block 49 are in contact with a spacer 50 which is disposed between the left hand longitudinal end of refractory plate 6 and the left hand inner end of sliding metal frame 3.

Due to the above construction, the bolt fastening force is uniformly transferred to sliding refractory plate 6 by way of spacer 50. If longitudinal spaces each of which are formed between one longitudinal side of sliding refractory plate 6 and that of metal frame 3 is left open without inserting spacers therein, the heat insulating effect may be improved.

However, from the practical point of view, the insertion of a wedge 51 or the intermittent charging of mortar into the spaces increase the structural or mechanical strength of the assembly and also enhance the stability of the assembly whereby the rupture of refractories can be avoided as much as possible and therefore the life of the refractories can be increased.

The bolts, of course, can be directed toward sliding refractory plate 6 not only from one direction but also from two or more directions, such as two opposed directions or three or four directions wherein the securing effect which may be equal to or greater than the effect obtained by the insertion of wedges can be obtained.

When the refractories and the encasing metal frame have a circular configuration, the refractories must be secured from a greater number of directions.

Threading kinetic pair including refractories setting threads 48 can be conducted in other ways which are known to those who are skilled in the art, including a method where the female thread is directly formed in sliding metal frame 3 besides using blocks 49.

It is necessary that the threading portion of the bolts and the corresponding female threads are coated with a seizure preventing agent since the bolts and other elements are subject to extremely high temperature.

Furthermore, if spacer 50 is provided with recesses into which the distal ends of refractory securing bolts 48 are disposed, the securing of the sliding refractory plate with in the sliding metal frame is further stabilized.

The refractories assembly disclosed in FIG. 24 has substantially the same construction as that of the assembly shown in FIG. 23 with the exception of the location where the bolts are fastened.

Namely, corners of the left hand side of sliding refractory plate 6 are cut off at 45° angles thus forming oblique corners 6*b*. Corresponding to the location of corners 6*b* spaced-apart bolt openings are formed at both sides of the left end rib of sliding metal frame 3 in the same way as described in the foregoing assembly.

Bolts 48 pass through the above bolt openings and are threaded through blocks 49' each of which is positioned within the recess formed to one side of the above mentioned left hand end rib of sliding metal frame 3. Bolts 48 have the distal ends thereof threaded into a slide block 52 which has an oblique corner complementary to and in contact with the oblique corner 6*b* of sliding refractory plate 6. The bolt fastening force is thus transferred to sliding refractory plate 6 by way of the above mentioned mechanism.

In this assembly, since the sliding refractory plate is provided with a securing force which is divided into two different directional forces, the sliding refractory plate is effectively and securely fastened. (Refer to FIGS. 23 and 24). As a modification of the above securing mechanism, a metal hoop may be wound tightly around the periphery of the refractory plate and a heat resistant flexible sheet may be adhered to the non-sliding side of the refractory plate. Furthermore, an iron plate, for adjusting the thickness of the refractory plate, can be adhered to the outer surface of the above sheet.

The plates for the sliding nozzle which are constructed or assembled in a way described heretofore have the following advantages;

(a) When the refractory plate becomes thinner, the reduced thickness can be covered by varying the thickness of the iron plate to be inserted.

(b) If desired, the thickness of the refractory plate can be varied.

(c) Since the iron plate is coated on the outer surface of the refractory plate to protect the surface of the refractory plate, the heat resistant flexible sheet does not rupture and the mounting of the refractory plate can be easily and rapidly conducted.

(d) In the dismantling of the refractory plate, since the iron plate covers the surface of the heat-resistant flexible sheet, the iron plate can be easily separated from the metal frame of the sliding nozzle whereby the heat resistant flexible sheet can be prevented from seizing the above mentioned metal frame.

(e) The thickness of the plate which includes the refractory plate, sheet and iron plate substantially varies but so little that the variation of the sealing pressure can be restrained resulting in a low minor spring adjustment.

(f) When a tar impregnated refractory plate, is employed, the intermediate heat resistant flexible sheet absorbs the oozing tar even under such conditions where the infiltrating operation happens under high temperature, so that the oozing of the tar or the seizure caused by the oozing can be prevented.

(g) The oozing of the tar from the refractory plate and the absorption of the oozed tar by the flexible sheet further improves the contacting force between the sheet and the plate.

(h) Ruptures of the plate, which may occur during the transporation or handling thereof, can be prevented.

(i) Thickness and width of the refractory plate or the dimentional error of the metal frame can be adjusted by the hoop.

(j) Without disposing the packing material such as mortar or the like between the metal hoop and the refractory plate, the hoop can be squeezed or tightened, so that the hoop fastening operation can be conducted easily and a tight fit obtained.

(k) Even when fractures or cracks occur on the refractory plate, they are prevented from developing further by the metal hoop, whereby accidents which may result from the above fractures or cracks can be prevented and also the reliability of the refractory plate is improved.

(l) Since the hoop and the iron plate are constructed each as independent parts respectively, they can be independently adjusted corresponding to the various conditions relating to thickness, length and width of the refractory plate or the metal frame.

(m) Coupled with the winding of the metal hoop around the periphery of the refractory plate, the adhesion of the iron plate onto the bottom of the refractory plate prevents the falling of ruptured pieces of the refractory plate at the time of the dismounting operation whereby the above dismounting operation can be simplified.

(3) About the power-operated closure mechanism of the sliding nozzle:

As means or mechanisms for closing or opening the sliding nozzle, hydraulic means and electric or power-operated means can be considered. This paragraph discloses power-operated means.

Figure 25:
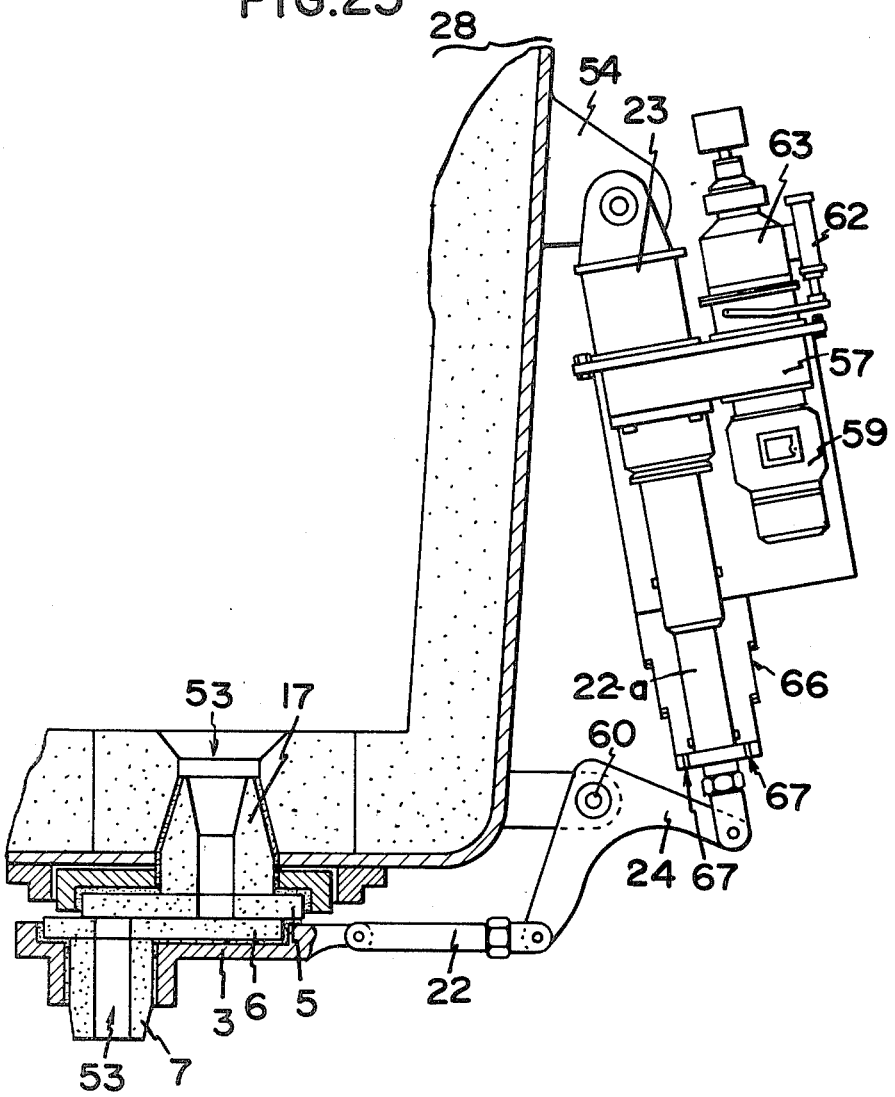
FIG. 25 is a fragmentary longitudinal cross sectional view of a sliding nozzle showing especially a reciprocating mechanism for controlling the sliding movement of the sliding refractory plate of this invention.
Figure 26:
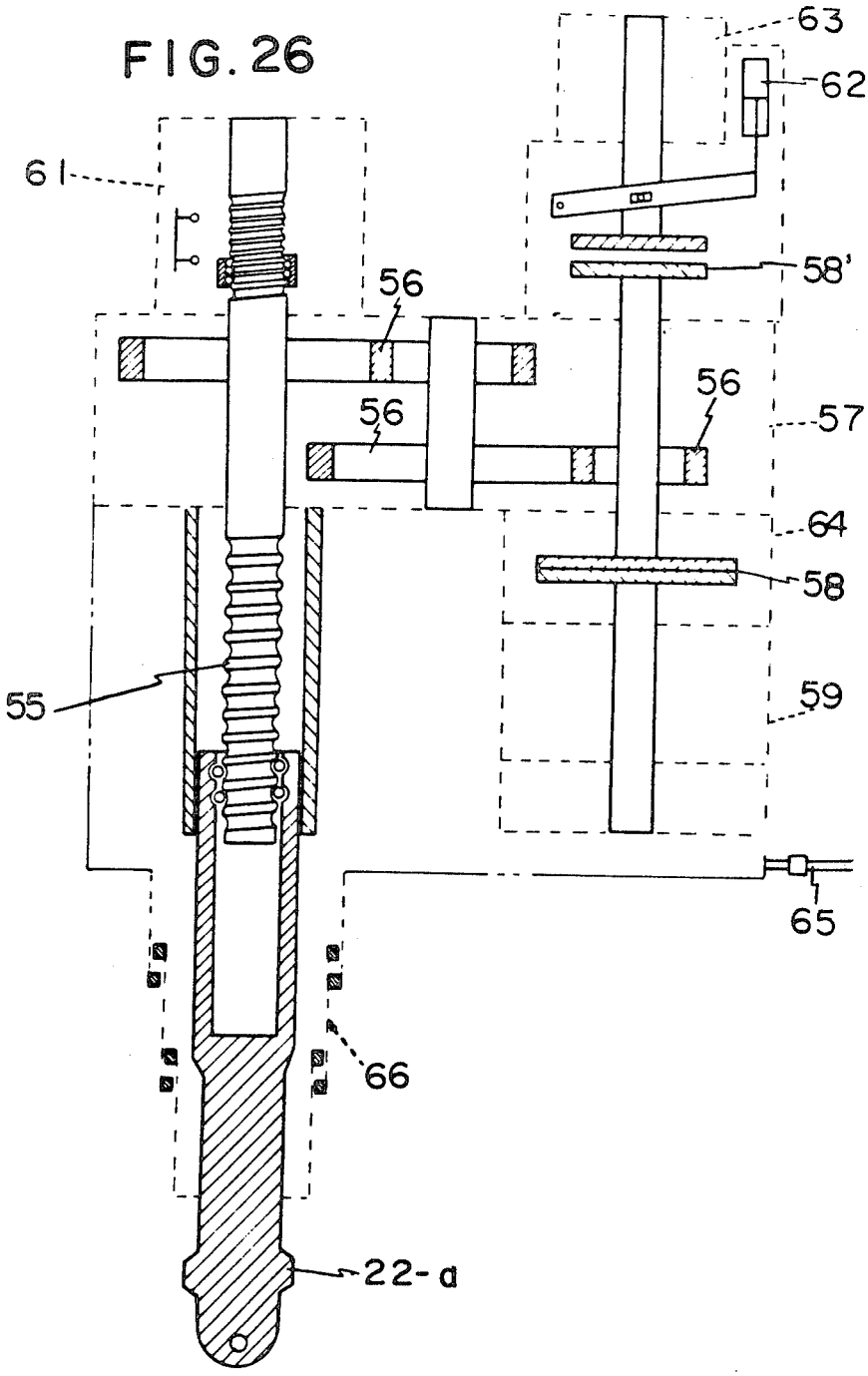
FIG. 26 is an enlarged schematic view showing the power transmission mechanism of the power-operated cylinder which constitutes a part of the reciprocating mechanism shown in FIG. 25.

In FIGS. 25 and 26, for opening or closing a pour opening 53 formed at the bottom of vessel 28 containing molten metal, stationary refractory plate 5 is superimposed above sliding refractory plate 6 which is provided with the pouring refractory nozzle 7 on the lower portion thereof sealed tightly against the lower surface of stationary refractory plate 5 by mean of sliding metal frame 3. Sliding metal frame 3 has one longitudinal end connected with one leg of an L-shaped pivotable arm 24 by way of reciprocating lever 22. Arm 24 is pivotable on a pivot pin 60 which is mounted on a lug secured to vessel 28. Arm 24 has another leg thereof connected to an actuating rod 22*a* of the power-operated cylinder 23 which extends downwardly substantially parallel to the side wall of the vessel 28. The actuating rod 22*a* has the upper end thereof mated with a threaded vertical shaft 55 (note FIG. 26). This shaft 55, in turn, is provided with gear trains 56 which connects shaft 55 with a power-operated motor 59 by way of a reduction device 57 and a disc clutch 58 such that the actuation of the motor 59 causes the rotation of threaded shaft 55.

Due to the above mentioned construction, when motor 59 is driven, the threaded shaft 55 is rotated by way of gear trains 56. This rotation of threaded shaft 55 causes the pivotal movement of L-shaped arm 24. Thereupon, sliding refractory plate 6 is caused to slide relative to plate 5. When opening 53 of sliding refractory plate 6 comes into alignment with opening 53 formed in stationary refractory plate 5, at which time molten metal flows through the opening from the vessel at maximum flow, a limit switch 61 which is disposed above threaded shaft 55 is activated so that further sliding of sliding refractory plate 6 is prevented.

When the closing of the pour opening is required, power-operated motor 59 is driven in reverse direction so that L-shaped arm 24 is pivoted in a clockwise direction so as to cause the imperforate portion of sliding refractory plate 6 to close the pour opening 53.

When the power-operated motor goes out of, order or when the current-supply to the motor stops suddenly, a pneumatic cylinder 62 is actuated to cause auxiliary clutch 58' to connect a pneumatically-operated motor 63 with gear trains 56 whereby the closing or the opening of pour opening 53 can be continuously conducted.

For protecting the closure mechanism from dust or high temperatures, a jacket 64 is provided over the closure mechanism wherein the jacket is supplied with a cooling agent such as cooled air through cooling agent supply lines 65 while pressure within the jacket is always kept higher than atmospheric pressure so as to prevent the infiltration of dust into jacket 64.

The jacket, as shown in FIG. 26, includes a flexible bellow means 66 which follows the movement of actuating rod 22*a*. In the drawings, numeral 67 indicates discharge outlets for the cooling agent.

The closure mechanism which employs the power-operated motor is much more free from trouble than a mechanism provided with a hydraulic mechanism so that the production of an ingot of an inferior quality which is caused by failure of the closure mechanism, can be prevented. Also the leakage of molten metal from the pour opening can be prevented and the closure mechanism is easily accessible for the maintenance thereof.

(4) Concerning elastic or spring elements for the application of sealing pressure:

In this invention, sealing pressure is applied between the refractory plates of the sliding nozzle by elastic elements such as spring means, which may comprise two kinds of springs which in turn differ in their spring characteristics wherein the spring characteristics change when the sealing pressure approximates the desired sealing pressure.

The construction and the features of the springs of this invention are described hereinafter.

Figure 27:
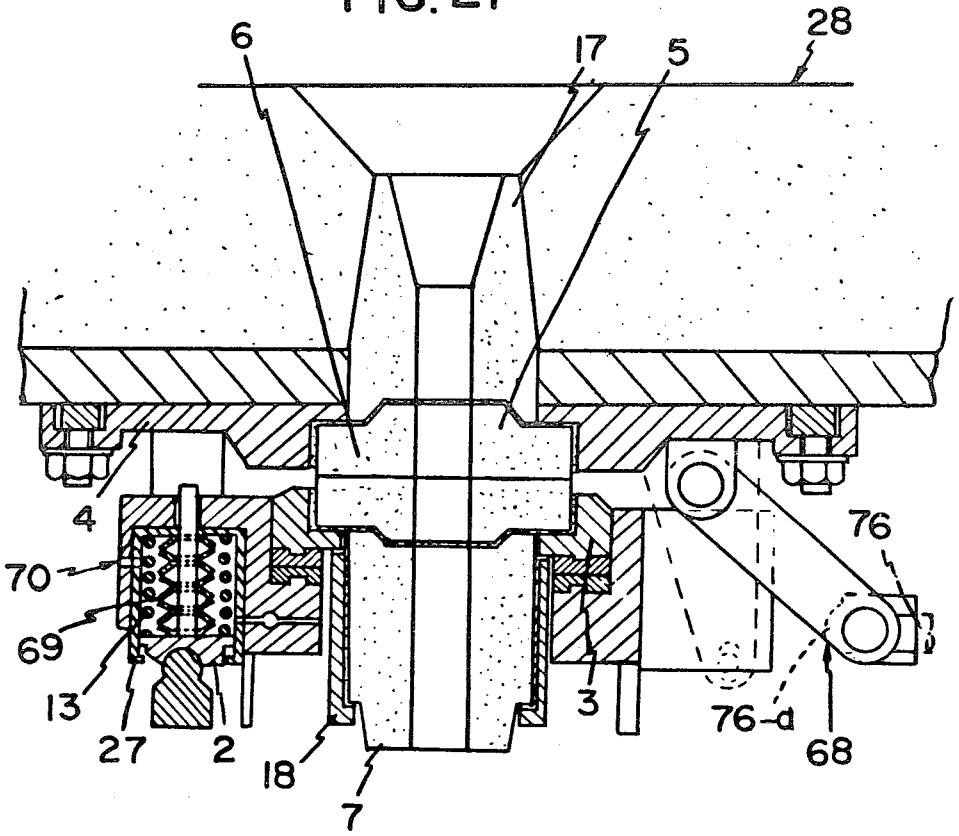
FIG. 27 is a transverse cross sectional view of a sliding nozzle of this invention wherein a spring means is shown in detail.

FIG. 27 shows a spring means for the application of sealing pressure which comprises coil springs and initially coned disc springs disposed concentrically within the coil springs, wherein numeral 17 indicates the upper refractory nozzle encased at the bottom of vessel 28, numeral 4 indicates the fixed metal frame, numeral 6 indicates the sliding refractory plate, numeral 3 indicates the sliding metal frame and 2 indicates the lower spring holding means. Numeral 68 indicates a toggle mechanism which is rotatably mounted on fixed metal frame 4 and which fastens sliding metal frame 3 to fixed metal frame 4, numeral 13 indicates coil springs which are located within spring box 27 and which are depressed by toggle mechanism 68; 69 indicates the initially cone-shaped springs disposed concentrically within coil spring 13, 70 indicates an air cooling aperture formed in the wall of spring box 27, formed to introduce cooling air into the spring box 27 so as to prevent the retardation of the spring characteristics of the springs.

The operation to apply sealing pressure between fixed refractory plate 5 and slidable refractory plate 6 is conducted by the press means of this invention (not shown in the drawings) and is held by toggle mechanism 68.

In this invention, the refractory plates of the sliding nozzle are first pressure-sealed only by coil springs 13 wherein initially cone-shaped springs are not involved in the application of sealing pressure and the above sealing condition is preserved. The above spring setting condition is shown in FIG. 28 where (a) shows spring means where neither the coil springs nor the initially cone-shaped springs are loaded with force to depress the springs.

(b) indicates the spring means in a condition where the coil springs 13 are depressed but the initially cone-shaped springs are not loaded with force sufficient to be depressed, and are slightly in contact with the loading means.

In other words, the spring means must be set such that the biasing force of the coil springs corresponds to the desired sealing pressure which must be applied between the refractory plates.

Initially cone-shaped springs 69 are set such that they produce the desired amount of biasing force which will be added to the force exerted by the coil springs 13 only when the coil springs 13 cannot maintain the desired force due to the deterioration of the spring characteristics thereof, caused by some possible conditions during the sealing operation.

For example, when the sealing pressure is applied by merely coil springs 13, the spring characteristics thereof assume an inclined linear line as shown in FIG. 29 which is a force-deflection chart. Therefore, as the spring characteristics of the springs deteriorates, the desired sealing pressure cannot be maintained even when the coil springs are compressed to the same length as that of the coil springs of the initial loading whereby molten metal may leak from the intersealing surface. In this invention, since the spring bias means consists of two kinds of springs which are assembled together, the spring characteristics thereof vary acutely at an inflection point in FIG. 29 where the desired sealing pressure is exerted so that even when the force of the coil springs is weakened due to the deterioration of the springs, the initially cone-shaped springs which have a small deformation rate compared to that of the coil springs, and can compensate for the lack of sealing pressure whereby the desired or predetermined sealing pressure is constantly applied onto the intersealing surface of the refractory plates.

In this invention, as shown in FIG. 30, the spring characteristic of one spring meets that the other spring at the predetermined sealing pressure point and the combined spring characteristics continuously change.

However, it must be noted that the springs of this invention can assume other spring characteristic which terminates once at the predetermined sealing pressure point and FIG. 32 discloses a spring characteristic which forms a curved line.

Furthermore, the combination of two kinds of springs contemplates a combination of the same type of springs which differ in their deformation rate.

The method of mounting the springs also includes the mounting of the initially cone-shaped springs around the coil springs or disposing both springs in parallel.

As has been described heretofore, in the case where sealing pressure is applied between the refractory plates, only the coil spring (which has a greater deformation rate) can exert the biasing force and the initially cone-shaped spring (which has a lower deformation rate) shows no deflection thereof in normal sealing operation. When the spring characteristics of the coil spring deteriorates, the smaller spring deflects.

Namely, deflection increases rather sharply from a predetermined sealing pressure point so as to cover the additional necessary sealing pressure whereby the sealing effect is maintained.

When a foreign material such as minute metal piece which tends to expand the sliding interfaces, infiltrates between the refractory plates, deflection also increases from the predetermined sealing pressure point so that the sealing pressure increases and prevents the expansion of the interface of the refractory plates.

The box for containing the coil springs and the lower metal frame may be made of a material of high rigidity and of some elasticity so that the above-mentioned sealing effect can be obtained by the combination of an elastic box, an elastic lower metal frame and coil spring.

As has been described heretofore, according to the method of this invention, the desired sealing pressure can be maintained between the refractory plates by the activation of the second springs, even if the first springs deteriorate so that the replacement of the springs becomes far less frequent and the life of the springs can be greatly improved whereby the interruption of the pouring operation can be minimized considerably.

Furthermore, the stable and accurate sliding nozzle regulating operation can be conducted for a long period of time and the leakage of molten metal through and between refractory plates can be effectively prevented.

Figure 33:
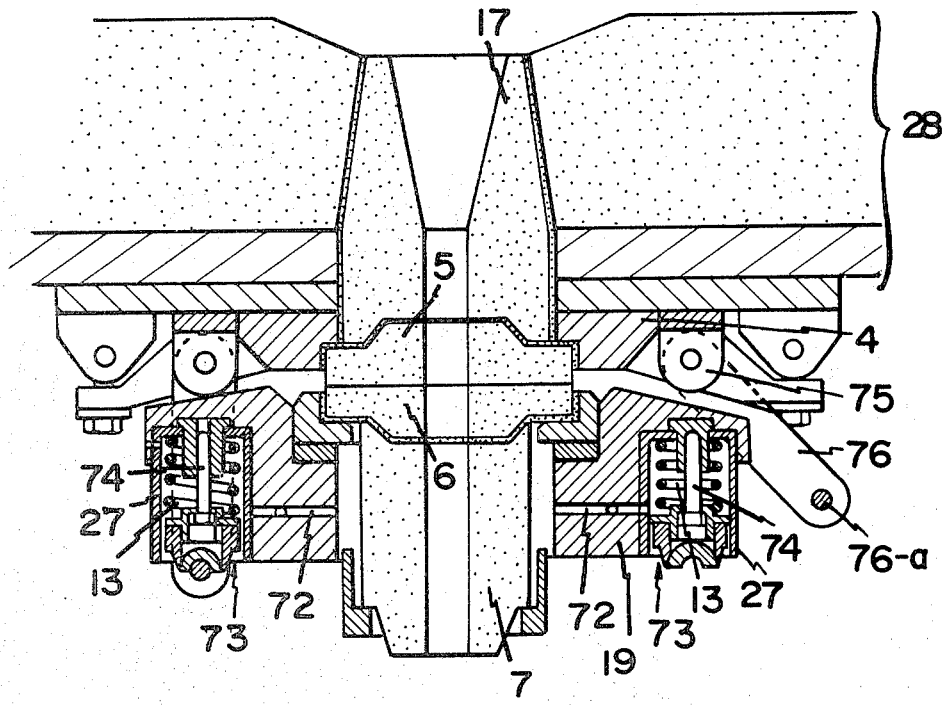
FIG. 33 is a transverse cross sectional view of a sliding nozzle of this invention wherein the spring means which provides the desired sealing pressure between a stationary refractory plate and a sliding refractory plate is shown in greater detail.
Figure 34:
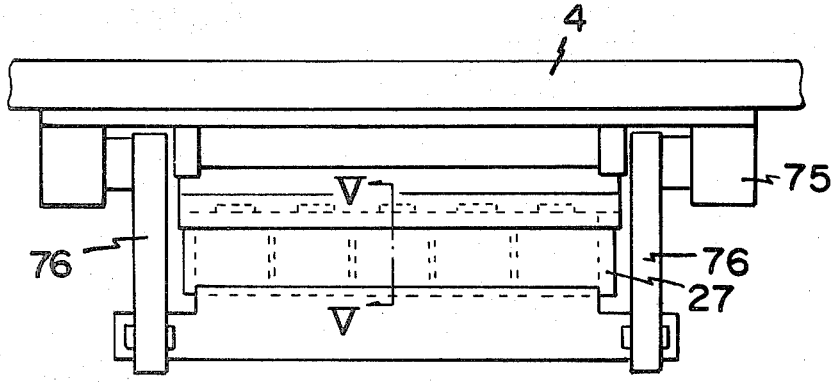
FIG. 34 is a longitudinal elevational view of the sliding nozzle of FIG. 3.
Figure 35:
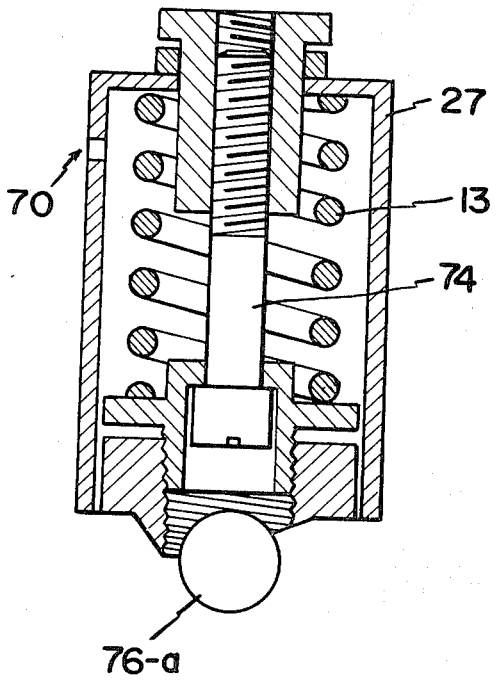
FIG. 35 is an enlarged isolated cross sectional view taken along line V—V of FIG. 34 showing the construction of a single spring means.

Another modification of elastic means which can be employed to apply a sealing pressure between the intersurfaces of the fixed refractory plate and the sliding refractory plate is described hereinafter with reference to FIGS. 33 through 35.

In the construction of the sliding nozzle where sliding metal frame 3 mounts pouring refractory nozzle 7 which in turn is slidably disposed within closure metal frame 19, apertures 72 are formed on the both sides of closure metal frame 19 parallel to the lower surface thereof.

Two sets of a plurality of springs 13 are disposed in elongated spring boxes 27 which are provided in parallel relation on the respective sliding sides of the closure metal frame and can be replaced toward the bottom.

Spring receiving means 73 consists of a lever-receiving portion and a spring adjustment shaft means 74 which works as a guide means for upward and compressing movement of spring 13 and has the upper end thereof disposed within a protrusion which is in turn disposed within spring box 27 and is an integral part of closure metal frame 19.

In both sides of fixed metal frame 4, lugs 75 are fixedly secured. A lever 76 has the proximal end thereof rotatably secured to lug 75 and has the distal end thereof provided with a shaft **76*a* such that shaft 76*a* urgedly rests within the recess formed in the lever receiving portion of the spring receiving means 73 by rotating lever 76 after spring means 13 are compressed by press means 12 which is not shown in the drawings so that spring receiving means 73** are pressed upwardly and settled.

According to the above operation, the total elastic force of the springs affects the entire portion of closure metal frame 19 and therefore sliding refractory plate 6 is pressure-sealed onto stationary refractory plate 5.

Still another modification of the elastic mean for applying a sealing pressure between refractory plates is described hereinafter.

Although this modification describes the same construction as that of the foregoing modification, as shown in FIG. 36 instead of spring adjustment shaft 74, sealing pressure adjustment bolts 77 are threaded into closure metal frame 3 and the upper plate of spring box 27. These adjustment bolts 77 are first set such that they exert no force onto spring means 13. They may be further threaded into the corresponding parts such that the lower ends can press against the springs 13 to cause them to exert an elastic force which ajusts the sealing pressure.

In this modification an aperture for supplying cooling air to the spring boxes 27 and closure metal frame 19 is provided.

According to this invention, the elastic force of the elastic means which are disposed within the closure metal frame is transferred to the interfaces of the fixed refractory plate and the sliding refractory plate by way of support arms wherein since the contiguous sliding surfaces of the refractories are subject to uniform sealing pressure, the sliding refractory can smoothly slide to regulate the flow of poured molten metal without causing any clearance between the refractory plates.

Accordingly, the shortening of the life of the sliding refractory plate or the failure of the opening or closing operation, both of which are caused by the infiltration of molten metal between the interface of the refractory plates, can be prevented, resulting in greatly improved operability of the sliding nozzle.

(5) The structure which enables easy replacement of the pour opening portion of the sliding nozzle when the above portion is damaged:

Conventionally, especially in the past decades, where remarkable improvements have been made to the continuous casting machines, sliding nozzles have been widely and predominantly employed in the regulation of molten metal passing through the pour opening of the molten metal ladle vessel.

Such sliding nozzle mechanisms are substantially constructed such that upper refractory nozzle 17 and lower pouring refractory nozzle 7 are communicable with each other and fixed refractory plate 5 and sliding refractory plate 6 are disposed the between upper refractory nozzle 17 and the lower pouring refractory nozzle 7. The sliding refractory plate 6 is slidable horizontally relative to the stationary refractory plate and thereby determine the relative relationhsip of the openings formed in the respective plates so as to regulate the pouring of molten metal from the vessel.

In the above construction, pouring refractory nozzle 7 which constitutes the pouring opening must be replaced frequently since the nozzle is damaged by molten metal such that the diameter thereof is enlarged. In this case, since pouring refractory nozzle 7 must be disassembled from the sliding refractory plate 6, sliding refractory plate 6 is exposed to the atmosphere so that cracks may occur in the plate due to spalling and the sliding refractory plate 6 may thus be easily damaged. This implies that in recent casting processes where the pouring of molten metal must be strictly and precisely regulated, pouring refractory nozzle 7 must be frequently replaced in order to resolve the above-mentioned problems. This situation has created a grave concern in the industrial field.

From the point of view of the operation for replacing the lower pouring refractory nozzle, since sliding refractory plate 6 and pouring refractory nozzle 7 are fixedly secured to each other by the sintering of the mortar interposed therebetween, it is a great disadvantage to the above replacing operation to break or sever the firm joint thus formed.

It is an object of construction to be described to provide a sliding nozzle mechanism which resolves the aforementioned problems.

Figure 40:
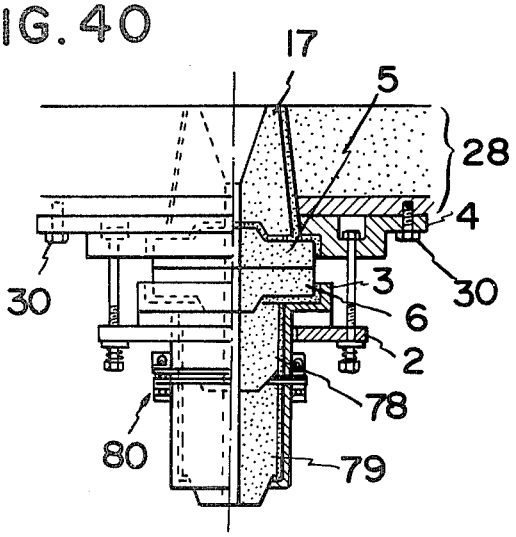
FIG. 40 is a transverse cross sectional view of a sliding nozzle of this invention wherein the pouring nozzzle includes a replaceable section.
Figure 41:
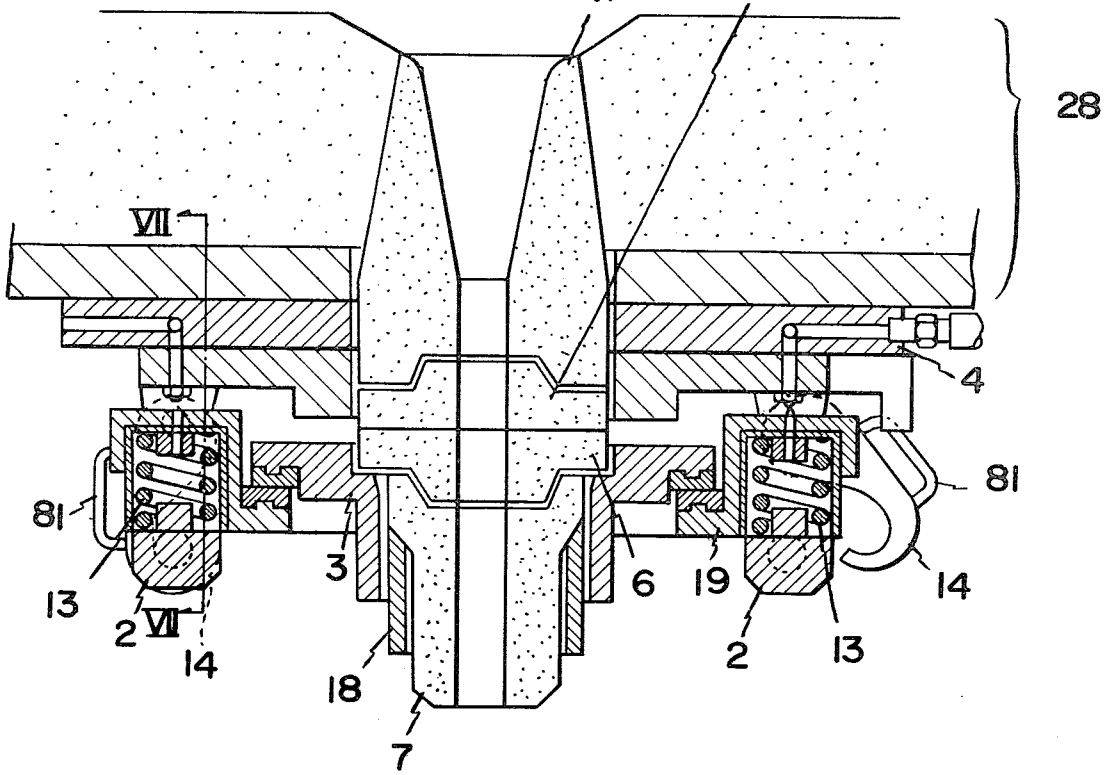
FIG. 41 is transverse cross sectional view of a sliding nozzle of this invention wherein hooks are employed to connect the lower metal frame to the upper metal frame.
Figure 42:
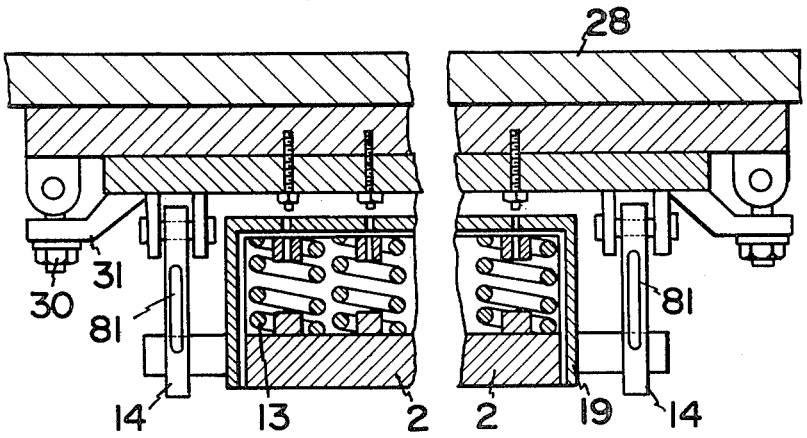
FIG. 42 is a cross sectional view taken along line VII—VII of FIG. 41.

A sliding nozzle mechanism is which shown in FIG. 40 regulates the pouring of molten metal from the vessel by means of a horizontally slidable plate wherein a heat-insulating upper-positioned pouring refractory nozzle section 78 is attached to the bottom of sliding refractory plate 6 and a lower positioned refractory nozzle section 79 which has an opening communicating with the corresponding opening of upper-positioned refractory nozzle 78 is replaceably connected to the bottom of upper-positioned refractory nozzle 78 coaxially.

In the drawings, numeral 80 indicates a means which replaceably mounts lower-positioned refractory plate 79.

Corundum or zircon, which shows high corrosion-resistance, and high spalling resistance, can be considered as material for upper-positioned refractory nozzle 78 and for lower-positioned refractory nozzle 79. Especially chamotte, agalmatolite (roseki) can also be considered as material for the lower-positioned refractory nozzle 79. Preferably, these refractory nozzles 78 and 79, should have the inner peripherial walls thereof made of high corrosion-resistant materials and the outer peripheral walls thereof made of heat-insulating material. This condition is strictly required with respect to the upper-positioned refractory nozzle 78.

In practice, the length of lower-positioned refractory nozzle 79 is preferably 1.5–4 times longer than that of upper-positioned refractory nozzle 78. The opening diameter of lower-positioned refractory nozzle 79 may, if desired, be varied so as to facilitate the regulation of the pouring of molten metal through the opening.

The concept of this construction is applicable not only to sliding nozzles but also to any device which has the pour opening portion thereof, namely the lowermost portion which is exposed to the atmosphere and is thereby damaged.

In this invention, when lower-positioned refractory nozzle 79 which is mounted onto the lowermost portion of the pour opening, is damaged by molten metal, it can be replaced by means of replacing means 80. Since the sliding refractory plate 6 is not exposed to the atmosphere during the replacing operation damages such as spalling do not occur on the sliding refractory plate for a long period of operation.

Furthermore, the replacement operation can be easily conducted.

The following advantages can be brought about:

(a) Since damages to the sliding refractory plate can be decreased to a minimum level and lower-positioned refractory plate 79 can be replaced for each charge, the sliding nozzle can function to its full extent and the pouring of molten metal can be accurately and reliably regulated.

(b) Since lower-positioned refractory nozzle 79 can be simply replaced, the efficiency of the operation is enhanced.

(6) Sliding nozzle means provided with retaining means

Hook shaped replacing means may be constructed such that stationary refractory plate 5, which is fixedly mounted on the molten metal containing vessel, and the sliding refractory plate are assembled tother and whereby fixed metal frame 4, engages with sliding metal frame 3 which mounts the sliding refractory plate 6 so as to exert the desired sealing pressure between refractory plates 5 and 6 and determine the sealing pressure. Lower support means 2 which include elastic elements as substantial parts thereof are carried by closure metal frame 19 at both sides thereof and they are also loosely suspended from fixed metal frame 4. The sliding refractory plate 6 and fixed refractory plate 5 have their contacting surfaces pressed against each other by press means 12 (not shown in all of the figures of the drawings), and the sliding refractory plate is latched to fixed metal frame 4 by retaining means 14 which have their proximal ends pivotally mounted on fixed metal frame 4.

In installing or mounting the sliding nozzle means of this construction, the vessel is first positioned horizontally such that the bottom of the vessel is perpendicular to the floor.

The sliding nozzle is prepared in a completed form, by preassembling all the elements and by applying a desired sealing pressure between the refractory plates. Subsequently, brackets of the preassembled sliding nozzle are engaged with retaining brackets 31 provided on the bottom of vessel 28 whereby the mounting operation is completed. This comprises the mounting operation of a cassette-type sliding nozzle means.

In assembling the sliding nozzle means, which is conducted on the floor below the vessel, the structure composed of parts including the fixed metal frame 4 and the lower pouring refractory nozzle 7, is positioned on the floor such that pouring refractory nozzle 7 is inverted.

To be more specific, fixed metal frame 4 is placed on the floor with the surface thereof which comes into contact with the bottom of the vessel facing the floor; then stationary refractory plate 5 is assembled into metal frame 4. During the above operation, hooks 14 must be expanded outwardly. Subsequently, sliding metal frame 3 on which are mounted the sliding refractory plate 6 and the lower refractory nozzle 7 thereon, is mounted on stationary refractory plate 5. Further, on sliding metal frame 3, the assembled structure composed of lower support plate 2, elastic means such as springs 13 and spring-receiving means are mounted. Then the press means 12 for applying sealing pressure between the refractory plates (not shown in drawings) fasten the components together and also compresses the springs. When the springs are deflected to a predetermined extent, hooks 14 each of which has a handle 81, are rotated inwardly and are engaged with protrusions extending from a portion of lower support means 2 so that the operation to apply the predetermined sealing pressure is completed and the entire assembly of the sliding nozzle is completed.

After the above sequential operation, the means to apply sealing pressure is removed so that the sliding nozzle means is now ready to be mounted onto the bottom of the vessel.

According to this sliding nozzle means, the operation to complete the application of sealing pressure can be easily and rapidly conducted by merely engaging hooks.

Furthermore, since a mechanism such as a toggle means which occupies a substantially large space below the bottom of the vessel is unnecessary and the entire structure of the sliding nozzle is thin in thickness, the space between the bottom of the vessel and the ingot mould which is usually very narrow, can be effectively used.

(7) Application of the method of this invention to a swinging-type sliding nozzle and the improvement related to above sliding nozzle The method for obtaining the desired sealing pressure between the refractory plates which has been described heretofore can be applied to swinging-type sliding nozzles as shown in FIG. 43 through FIG. 48 wherein the closure mechanism which includes the stationary refractory plate, the sliding metal frame and the spring means is first swingably rotated toward the bottom of the vessel until the stationary refractory plate fixedly encased within the fixed metal frame comes into contact with the sliding refractory plate. Subsequently the closure metal frame is urgingly pressed by the press means so that the sealing pressure is exerted between the refractory plates and finally the fixed metal frame is fastened to the closure metal frame by means of retaining means such as hooks or hangers.

A conventional open-type sliding nozzle substantially comprises a fixed metal frame fixedly enclosing a fixed refractory plate, a closure metal frame mounting a slidable metal frame in which a swingable refractory plate is enclosed, a pivoting means pivotally connecting respective sides of the fixed metal frame, and closure metal frame and a latching the means for latching other respective sides of the fixed metal and closure metal frame. When the latching means is released from the latching portion, the closure metal frame is swung to an open position about the point which pivotally connects the closure metal frame and fixed metal frame throughout the above swinging operation.

In the above conventional sliding nozzle, the pivoting portion thereof is constructed such that the fixed metal frame and closure metal frame are provided with respective brackets which protrude from their metal frames and are formed with pin-openings. These brackets are arranged such that the pin-openings come into alignment with each other so that a pivoting pin can pass through those openings.

Due to the above constuction, when the enclosure metal frame is pivoted on the pivoting pin which works as a fulcrum, the movable refractory plate and fixed refractory plate are both exposed to the outside so that the refractory plates can be replaced with new plates.

In general, the bottom plate of a ladle vessel onto which this sliding nozzle is mounted usually is provided with lengthwise and crosswise reinforcing ribs for reinforcing the bottom plate of the vessel and these ribs serve as legs when the vessel is mounted on a flow or a ground. Accordingly, the sliding nozzle is disposed in a place between the ribs or is enclosed by them, the overall thickness of the sliding nozzle being smaller than the height of the rib because if the thickness thereof is greater than the rib's height, the mounting of the vessel on the floor becomes unstable and may cause a problem for the sliding nozzle.

Furthermore, the pivoting pin which serves as a fulcrum for opening the nozzle must be positioned considerably lower than the distal edge of the reinforcing ribs. The full opening angle of the closure metal frame, therefore, cannot be sufficiently achieved and especially the turning thereof of 180 degrees is completely impossible, the maximum opening angle usually being a maximum of 90 degrees relative to the fixed metal frame.

In order to provide a sufficient angle to facilitate the replacing operation, the reinforcing rib must have a portion thereof cut off.

However, cutting-off of the reinforcing rib requires extra expenditures for the mounting of the sliding nozzle and also adversely-affects the rigidity of the ladle vessel.

The newly-devised closure mechanism for the sliding nozzle resolves the afore-mentioned disadvantages of conventional apparatuses in such a way that the closure mechanism can pivotally open the closure metal frame at a desired and sufficient angle without necessitating the cutting off of any of the reinforcing ribs.

The improvement of this closure mechanism is characterized in that the fixed metal frame and closure metal frame are pivotally but indirectly connected by way of a link arm. Due to such construction, in the opening of the closure metal frame, the arm(bracket) which can hang or suspend the closure metal frame is extended such that the pivoted portion of the closure metal frame (the extremity of the link arm) is positioned below the lower edges of the reinforcing ribs whereby the pivotal movement of the closure metal frame on the pivoting point can be conducted smoothly and sufficiently and furthermore the closure metal frame can be turned over.

The closure mechanism of the sliding nozzle is described hereinafter in great detail in conjunction with FIGS. 43 through 48 of the attached drawings wherein numeral 4 indicates fixed metal frame, numeral 5 indicates the stationary refractory plate, numeral 6 indicates the sliding refractory plate, numeral 3 indicates a sliding metal frame, numeral 19 indicates a closure metal frame, numeral **28*c* indicates bottom plate of ladle vessel 28 and numeral 28*d*** indicates the reinforcing ribs of the vessel.

Figure 43:
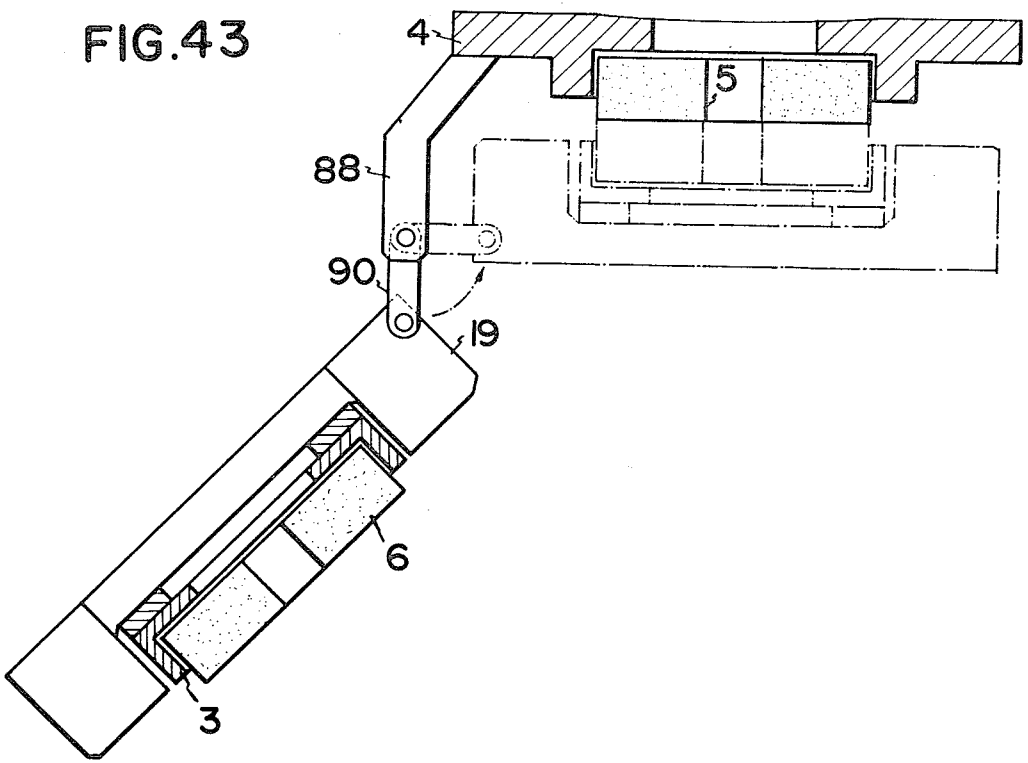

In FIG. 43, a bracket 88 which protrudes from fixed metal frame 4 has the free end thereof pivotally connected with one end of a link arm 90. The other end of arm 90 is pivotally connected with closure metal frame 19 so that fixed metal frame 4 is articulated with closure mechanism 19 by way of link arm 90.

Due to the above construction which is clearly shown in FIG. 43, the entire arm for suspending the closure metal frame can be extended at least by the length of link arm so that the pivoting point of closure metal frame 19 can be positioned below the lower edges of reinforcing ribs **28*d* whereby closure metal frame 19 which is pivotally suspended or hung from the end of link arm 90** is rotated with a sufficient opening angle without having the movement thereof defined by the reinforcing ribs, and furthermore the closure metal frame can be rotated so as to completely expose the refractory plates.

The protruding length of bracket 88 must preferably be predetermined such that (1) closure metal frame 19 can be swung so as to move sliding refractory plate 6 toward stationary refractory plate 5 until their respective sliding surfaces come into contact with each other and (2) when the stationary plate has the sliding surface thereof slidably in contact with that of the sliding plate, the line extending between the pivoting point shared by bracket 88 and link arm 90 and another pivoting point shared by link arm 90 and closure metal frame 19 can be disposed parallel to the stationary refractory plate. The breadthwise slipping off or lag of closure metal frame 19 relative to fixed metal frame 4 which occurs due to the scattering of the thickness of stationary and sliding plates when they are about to come into contact with each other can be minimized.

Figure 44:
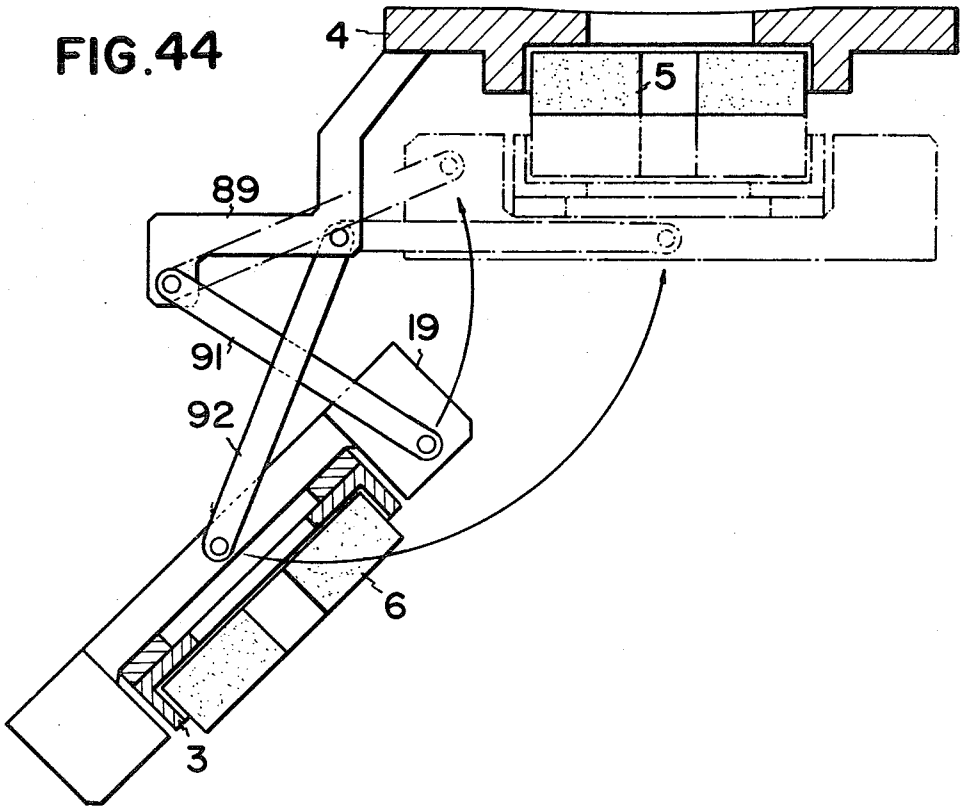

The same goes for the closure mechanism described in FIG. 44. FIG. 44 shows the improved type of closure mechanism which has been described heretofore in conjunction with FIG. 43.

Namely, the closure metal frame which is pivotally connected to the single link arm as shown in FIG. 43 freely swings during the opening operation thereof so that the movement of closure metal frame 19 is quite unstable during the replacing operation of sliding refractory plate 6.

The construction of the closure mechanism as shown in FIG. 44 is devised to solve the above mentioned disadvantage and is characterized by having a plurality of link arms which are pivotally connected to the different portions of closure metal frame 19.

In FIG. 44, closure metal frame 19 is connected to a bracket 89 secured to fixed metal frame 4 by way of a pair of link arms 91 and 92 which have one end pivotally connected to the different positions of closure metal frame 19 and have their other end pivotally connected to different portions of bracket 89.

Due to the above construction, the swinging movement of closure metal frame 19 during the opening thereof is restricted by a pair of link arms 91 and 92 on or along one locus so that tilting of closure metal frame 19 does not take place.

The pin opening formed in the end of link arm 91 which is alignable with the opening formed in the extreme end of bracket 89 may preferably be elongated in a lengthwise direction as shown in FIG. 44 so that when closure metal frame 19 is pivotally rotated so as to bring the sliding surface of sliding plate 6 into contact with the corresponding surface of fixed plate 5, closure metal frame 19 can be provided with a suitable degree of freedom in the rotation thereof on the pivoting point which pivotally connects link arm 92 and closure metal frame 19. FIG. 45 and FIG. 46 show other closure mechanisms of sliding nozzles, representing improvements of the closure mechanism shown in FIG. 43.

Those improved types of closure mechanism are characterized by having additional means thereof which prevent the closure metal frame from experiencing unstable movement which occurs freely during the opening of the closure metal frame and accordingly positions closure metal frame 19 at a desired position so as to facilitate the repairing operation of the refractory plates.

In FIG. 45, closure metal frame 19 is provided with a bracket 93 as the above additional means wherein an opening **93*p* formed in bracket 93 is disposed in alignment with an opening 91*p* formed in a middle portion of link arm 91 and subsequently a pin P is provided to connect bracket 93 with link arm 91 so that fixed metal frame 4** is fixedly held in any desired position.

In FIG. 46, brackets 94 and 95 are provided respectively on closure metal frame 19 and reinforcing rib **28*b* as additional means wherein the pin P passes through pin openings 94*p* and 91*p* formed in respective brackets 94 and 95 so as to fixedly hold closure metal frame 19** in any desired position.

Due to the above construction, as shown in FIG. 45 and FIG. 46 where closure metal frame 19 is opened and suspended from link arm 90, closure metal frame 19 is fixedly held and directed in a suitable direction so that the operation for replacing the refractory plates is facilitated.

Figure 47:
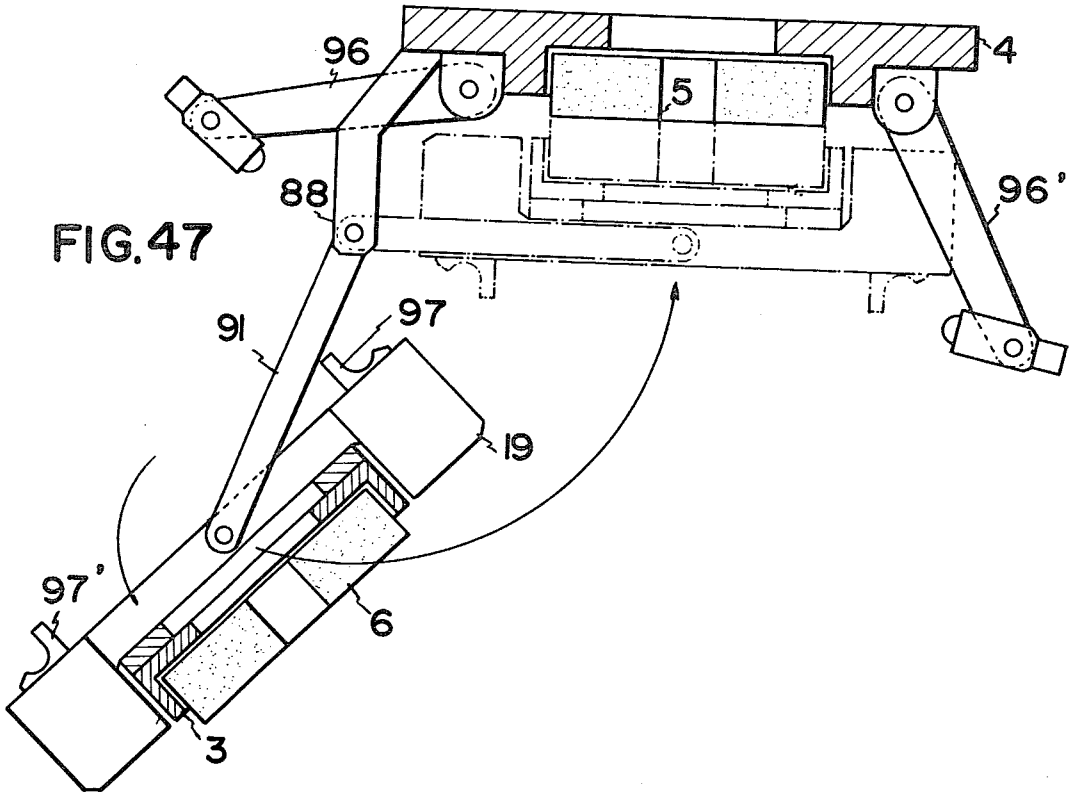
Figure 48:
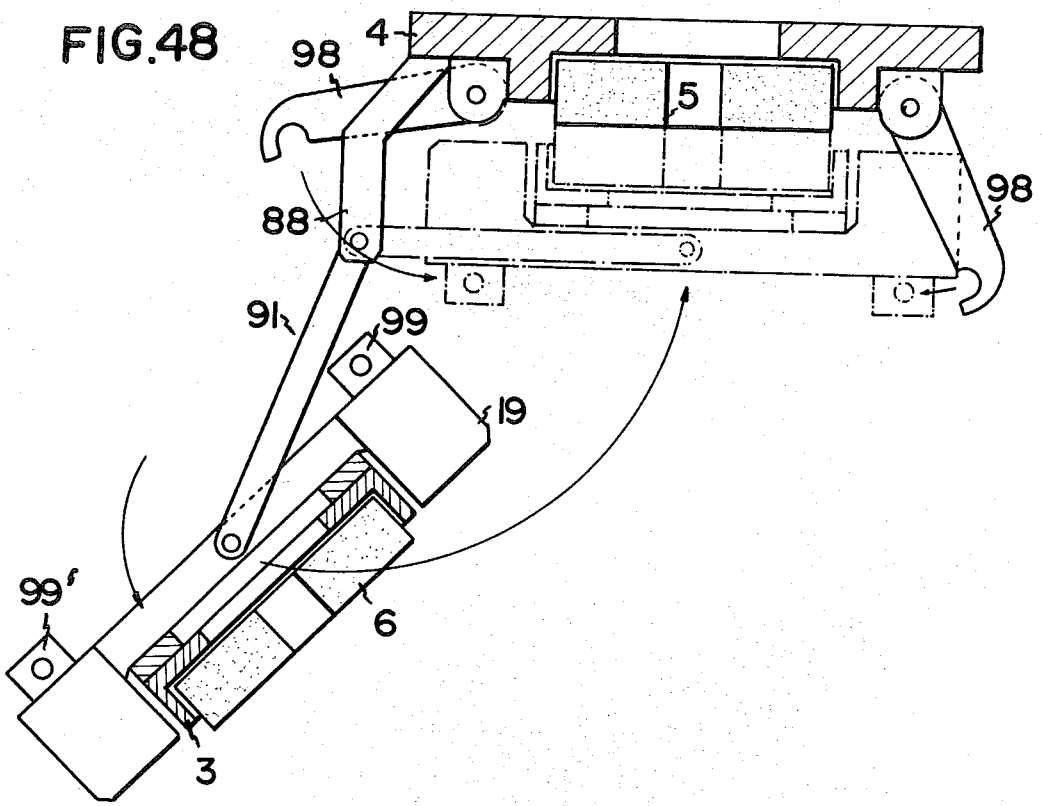

Preferred embodiments of sliding nozzle device which are respectively provided with desired latching means besides the closure mechanism of this invention are shown in FIGS. 47 and 48.

FIG. 47 shows a sliding nozzle device which adopts latch toggles as the latching means wherein fixed metal frame 4 and closure metal frame 19 are latchingly engaged with each other in such a way that latch toggles 96 and 96' which are pivotally connected to fixed metal frame 4 are engaged with latch portions formed at the bottom of closure metal frame 19. Subsequently the refractory plates which are enclosed by metal frames are provided with sealing pressure by press means 12 by way of spring means (not shown in this figure of the drawings), which are mounted on latch portions 97 and 97'.

FIG. 48 describes a sliding nozzle device which adopts hook means as the latching means wherein hook means 98 and 98' which are pivotally connected to fixed metal frame 4 are engaged with protrusions 99 and 99' which protrude from the front and rear ends of closure metal frame 19 in view of the sliding direction thereof after closure metal frame 19 is urgingly pressed onto fixed metal frame 4 so that closure metal frame 19 and fixed metal frame 4 are latchingly engaged with each other. Furthermore a desired amount of sealing pressure is applied between the refractory plates by means of the force of springs (not shown in FIG. 48) which are mounted on protrusions 99 and 99' which is exerted by press means 12 (not shown in FIG. 48).

What we claim is:

1. A method for applying and maintaining a desired sealing pressure between stationary and slidable refractory plates of a sliding nozzle assembly used in the regulation of the flow of molten metal from a vessel comprising:

positioning a sliding nozzle assembly which includes stationary and slidable refractory plates across the discharge opening of a vessel containing a molten metal, providing said sliding nozzle assembly and vessel with mounting means for detachably connecting a fluid pressure control device thereto, temporarily mounting said readily detachable fluid pressure control device to said sliding nozzle assembly and vessel, applying a controlled pressure by said fluid pressure control device to said refractory plates so that a desired sealing force is effected at the interface between said stationary and slidable plates, rigidly connecting said plates together by connecting means after said controlled pressure has been applied by said pressure control device, maintaining said desired sealing force by means of said connecting means, and removing said pressure control device from said sliding nozzle assembly, whereby said pressure control device is not subjected to the temperature of the molten metal during operation of the sliding nozzle assembly.

2. A method according to claim 1 further comprising applying a resilient force to said refractory plates by resilient means prior to connecting said plates together.

3. A method according to claim 1 further comprising measuring the pressure applied to the refractory plates by said control device, and regulating said pressure so as to provide a predetermined sealing pressure at said interface of said plates.

4. A method for applying and maintaining a desired sealing pressure between stationary and sliding refractory plates of a sliding nozzle assembly used in the regulation of the flow of molten metal from a vessel comprising:

positioning a sliding nozzle assembly which includes stationary and slidable refractory plates across the discharge opening of a vessel containing a molten metal, providing said slidding nozzle assembly and vessel with mounting means for detachably connecting a fluid pressure control device thereto, interconnecting resilient means between said stationary and slidable refractory plates to apply a desired resilient sealing force at the interface between said stationary and slidable plates to effect sealing at said interface as said slidable plate is reciprocated relative to said stationary plate, temporarily mounting said readily detachable fluid pressure control device to said sliding nozzle assembly and vessel, applying a controlled pressure by said fluid pressure control device to said resilient means so that said resilient means applies said desired sealing force at said interface between said plates, rigidly connecting said plates together by connecting means after said controlled pressure has been applied by said pressure control device, maintaining said desired sealing force by means of said connecting means and said resilient means, and removing said pressure control device from said sliding nozzle assembly, whereby said pressure control device is not subjected to the temperature of the molten metal during operation of the sliding nozzle assembly.

* * * * *